US005720118A

United States Patent [19]

Mayer et al.

[11] Patent Number: 5,720,118

[45] Date of Patent: Feb. 24, 1998

[54] INLAY FOR A SHOE

[76] Inventors: Helmut Mayer, Schonbuhl 10, D-7342, Bad Ditzenbach/Gosbach; Norbert Becker, Denzenbergstrasse 14, D-7400, Tübingen, both of Germany

[21] Appl. No.: 829,476

[22] Filed: Mar. 28, 1997

Related U.S. Application Data

[62] Division of Ser. No. 391,266, Feb. 21, 1995, abandoned, which is a continuation of Ser. No. 94,887, Jul. 22, 1993, abandoned, which is a continuation of Ser. No. 805,034, Dec. 11, 1991, abandoned, which is a continuation-in-part of Ser. No. 429,469, Oct. 31, 1989, abandoned.

[30] Foreign Application Priority Data

| | | | |
|---|---|---|---|
| Dec. 13, 1988 | [DE] | Germany | 8815488 U |
| Apr. 7, 1989 | [DE] | Germany | 8904336 U |
| May 12, 1989 | [DE] | Germany | 89005979 U |
| Oct. 25, 1989 | [EP] | European Pat. Off. | 89119833.5 |

[51] Int. Cl.[6] ..... A43B 23/00; A43B 5/00

[52] U.S. Cl. ..... 36/107; 36/44; 36/76 C; 36/30 R

[58] Field of Search ..... 36/76 C, 107, 36/108, 43, 44, 148, 149, 150, 151, 152, 27, 28, 30 R, 30 A

[56] References Cited

U.S. PATENT DOCUMENTS

| | | | |
|---|---|---|---|
| 1,308,395 | 7/1919 | Case | 36/30 A |
| 1,704,187 | 3/1929 | Glidden et al. | 36/44 |
| 2,124,819 | 7/1938 | Halloran | 36/30 R |
| 2,258,734 | 10/1941 | Brady . | |
| 3,444,630 | 5/1969 | Morelli . | |
| 3,492,744 | 2/1970 | Bernier et al. . | |
| 4,439,937 | 4/1984 | Daswick | 36/107 |
| 4,484,398 | 11/1984 | Goodwin et al. . | |
| 4,561,195 | 12/1985 | Onoda et al. | 36/30 R |
| 4,887,368 | 12/1989 | Latzke | 36/44 |
| 5,179,791 | 1/1993 | Lain | 36/43 |
| 5,220,735 | 6/1993 | Raoul-Duval | 36/108 |
| 5,285,583 | 2/1994 | Aleven | 36/44 |

FOREIGN PATENT DOCUMENTS

| | | |
|---|---|---|
| 0 044 549 | 1/1982 | European Pat. Off. . |
| 2 457 081 | 12/1980 | France . |
| 2 556 569 | 6/1985 | France . |
| 1 257 524 | 12/1971 | United Kingdom . |
| 2060350 | 5/1981 | United Kingdom | 36/107 |

*Primary Examiner*—M. D. Patterson

*Attorney, Agent, or Firm*—Burns, Doane, Swecker & Mathis, L.L.P.

[57] ABSTRACT

The invention provides an inlay for a shoe. The inlay extends at least within the forefoot region and comprises one piece of a hard plate material of uniform thickness. The plate material is formed with a profiling provided transversely to the longitudinal direction of the sole of the shoe. The transverse profiling extends at least throughout substantially the entire forefoot region of the inlay. The profiling has a cross-section consisting of periodically repeating cross-sectional profile elements, each of the cross-sectional profile elements comprising a ridge and a recess. The plate material is a resilient plate material.

18 Claims, 20 Drawing Sheets

1
2
3
P
L
Q
3
3
A
B
H
P

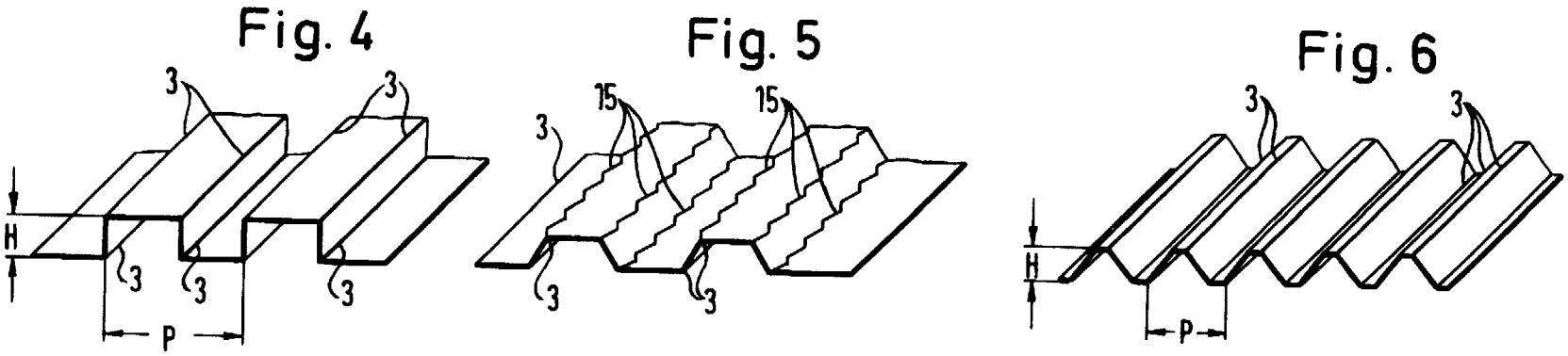
Fig. 6
Fig. 5
Fig. 4
3
15
P
H
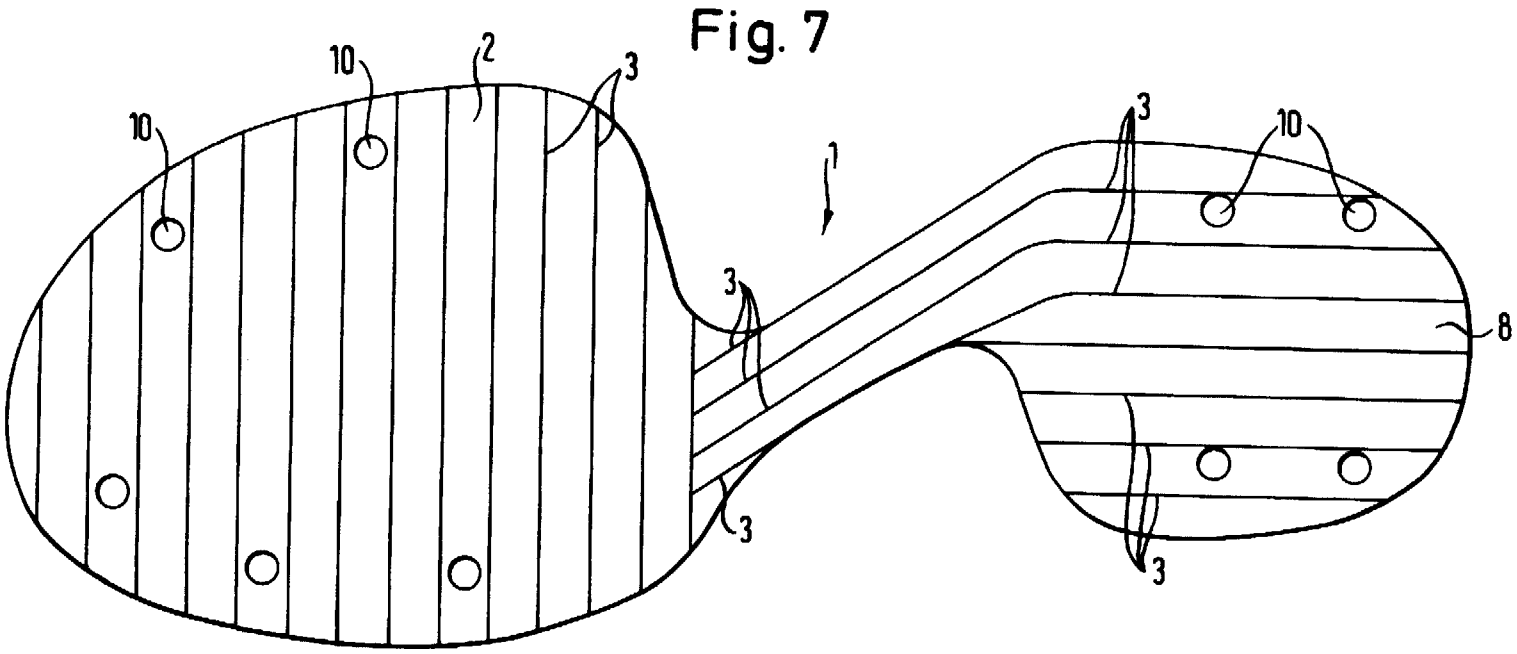
Fig. 7
1
2
3
8
10

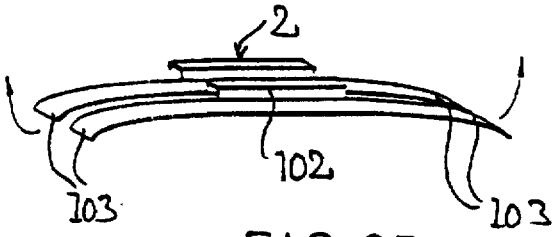
FIG. 25
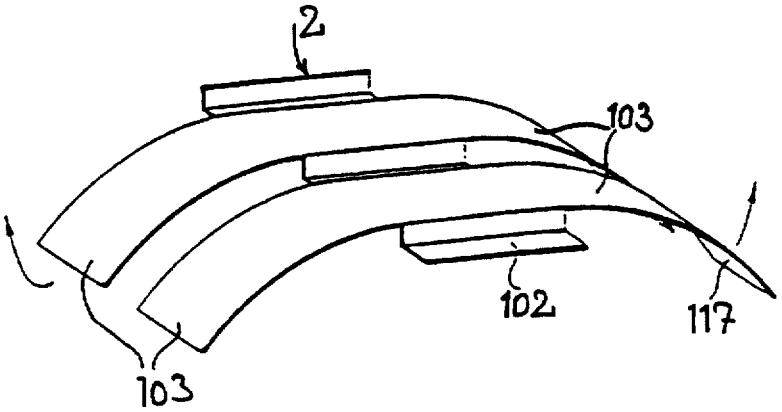
FIG. 26(a)
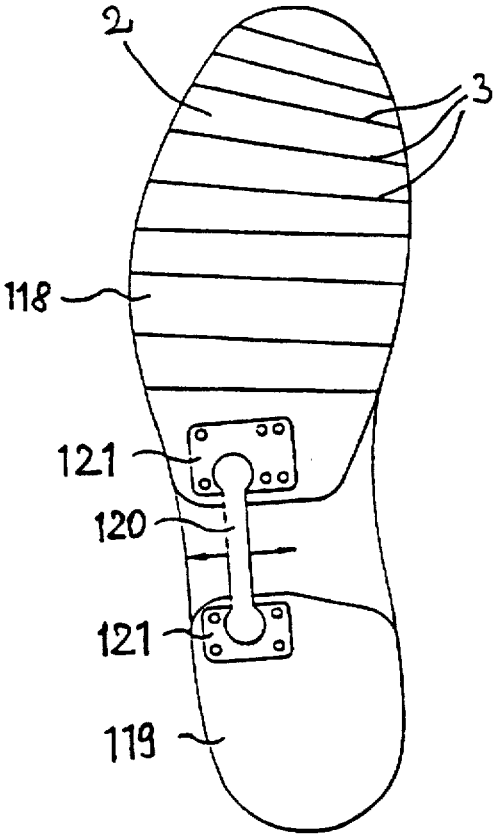
FIG. 26(b)
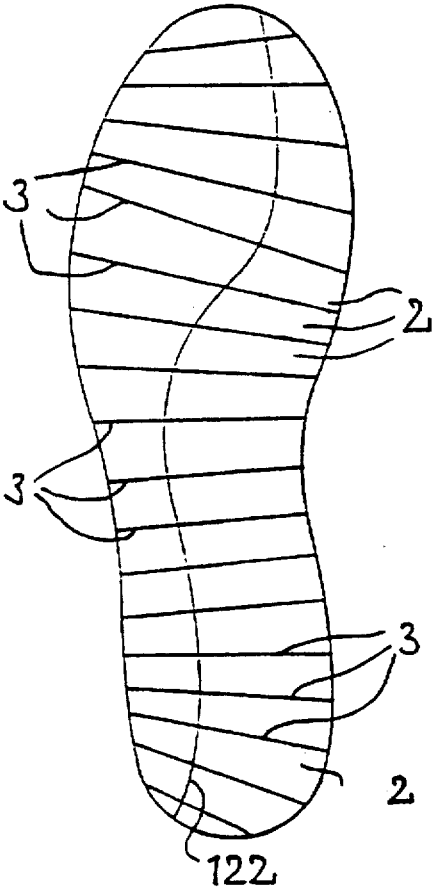

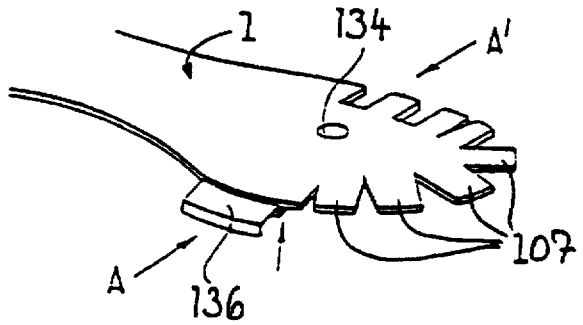
FIG. 32
FIG. 33(a)
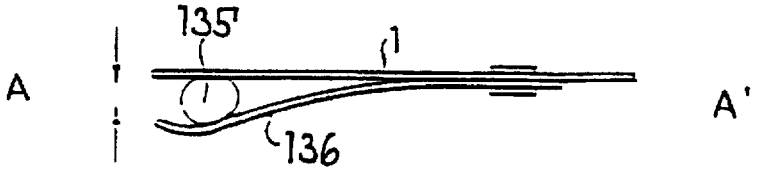
FIG. 33(b)
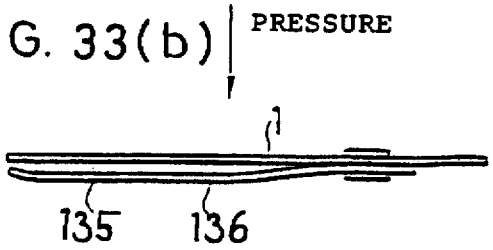
FIG. 35
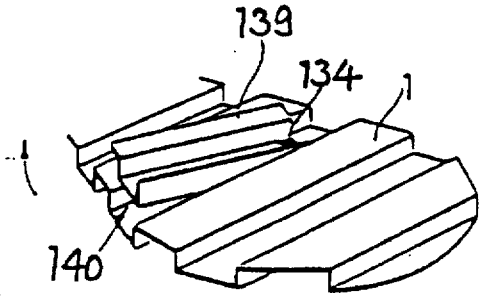
FIG. 34(a)
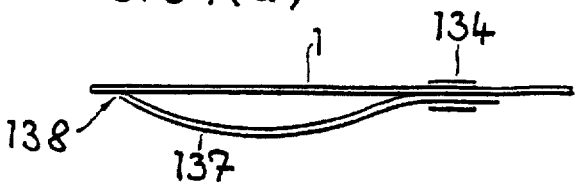
FIG. 34(b)
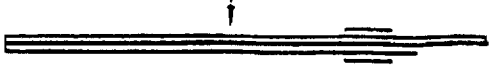

INLAY FOR A SHOE

RELATED INVENTION

This application is a divisional of Ser. No. 08/391,266 filed Feb. 21, 1995, now abandoned which is a continuing application of Ser. No. 08/094,887 filed Jul. 22, 1993, now abandoned which is a continuing application of Ser. No. 07/805,034 filed Dec. 11, 1991 now abandoned and which, in turn, is a continuation-in-part of Ser. No. 07/429,469 filed Oct. 31, 1989, now abandoned, respectively.

BACKGROUND OF THE INVENTION

1. Field of the Invention

The invention relates to an inlay for a shoe, in particular for a sport shoe, extending at least within the forefoot region of the sole, and preferably within the entire region of the foot. In addition, the invention relates to a sole provided with such an inlay and to a shoe having such a sole.

2. Related Art

With shoes in general and in particular with sport shoes such as, for instance, shoes for light athletics, mountaineering shoes, golf shoes, etc., it is important to design the shoe in such a manner that the risk of the foot snapping over towards the side and hence the risk of ligaments tearing or being strained is as small as possible. This risk of the foot snapping over towards the side is the larger, the higher is the laterally directed tilting moment acting upon the foot and the lower is, on the other hand, the resistance of the shoe to the lateral tilting moment. These two factors, i.e. the tilting moment on the one hand and the resistance of the shoe to the tilting moment on the other hand, are, leaving aside the extraneous conditions, determined above all by the design of the shoe:

(1) In the first place, the tilting moment is the larger, the higher is the force component directed towards the side, i.e. the tilting force acting upon the foot. This tilting force depends largely on the extraneous loading conditions, i.e. the loading conditions unaffected by the shoe, which, especially in sporting activities, are very pronounced, as a result of which sport especially leads with relative frequency to ligament tears or strains.

(2) In the second place, the tilting moment is the higher, the longer is, in physical terms, the lever arm, i.e. the greater is the distance between the foot and the ground. This means that all other conditions being equal the tilting moment increases with the thickness of the shoe sole.

(3) Whether a given tilting moment can in fact cause tilting and, as a result, snapping over of the foot towards the side, does not only depend on the absolute value of the tilting moment but also on the moment of resistance which the shoe opposes to a lateral tilting. This moment of resistance is the higher, the greater is the lateral stability of the shoe sole; i.e. the longer is the lever arm of the sole which opposes flexing in the transverse direction of the sole, by which is meant flexing about a flexing line parallel or roughly parallel to the longitudinal direction of the sole.

In the light of the above factors a very thin and stiff shoe sole would be ideal for making the risk of the foot snapping over to the side as low as possible. For if the shoe sole is very thin, the tilting moment is at a minimum, and if the shoe sole is very stiff there is a high moment of resistance which tends to prevent the tilting moment from actually causing lateral tilting. Such a shoe sole is, however, by no means ideal, since yet other requirements apply as regards the characteristics which a shoe should possess.

Whereas the wearer of such a shoe with a very thin and stiff sole would be able to stand well and safely on level ground, i.e. whereas such a shoe would ensure that the wearer's stability on level ground is good, the wearer of such a shoe could run with that shoe only with difficulty and insecurely, and in addition his stability on uneven ground would not be good, for the stiff sole of such a shoe would not adapt itself to uneven ground and make any roll-off motion of the shoe sole while running on the ground impossible. So as to enable the wearer of the shoe to run well and safely as a result of a good roll-off motion of the shoe sole on the ground, the shoe sole must be soft and flexible. This requirement for making the shoe sole soft and flexible and not rigid, does however, for the reasons below, entail the further requirement that the shoe sole must not be designed so as to be thin, as is, according to the above explanations, desirable in order to reduce risk of the foot snapping over, but that on the contrary it should be made thick.

For if a soft and flexible shoe sole is thin, point pressures acting from below on the sole of the shoe and caused, e.g. by little stones, unevennesses of the ground, etc., are transmitted through the sole of the shoe point-by-point to the sole of the wearer's foot, which is of course extremely uncomfortable and even distressing. In order to alleviate as far as possible such a transmission of point pressures to the sole of the wearer's foot and if possible even prevent it, it is therefore necessary to make the shoe sole, which must be soft and flexible in order to ensure good roll-off motion, as thick as possible.

Hence there are two opposite requirements as regards the design of the shoe sole:

(a) On the one hand the sole should be as thin and rigid as possible in order to make the risk of lateral snapping over of the foot and hence the risk of ligament tears and strains as low as possible.

(b) On the other hand, the sole should be as soft, flexible and thick as possible in order to enable a roll-off motion as required for running as well as secure standing on uneven ground while preventing, to the largest possible degree, the transmission of point pressures due to the ground.

Whereas according to the state of the art shoe soles with a stiffening inlay are known, the proposals as regards these known stiffening inlays are neither intended to provide a shoe sole meeting the two above opposed requirements, nor do these inlays constitute a solution of this problem:

From the British patent GB-A-1 257 524 a stiffening inlay from metal or a plastic material and provided with spikes is known, which is embedded in the sole of the shoe and intended especially for golf shoes. The purpose of this stiffening inlay consists in solving the problems in respect of spike retention and isolation of the foot from the pressure of the spikes when use is made of relatively light, soft and flexible cellular sole materials. Furthermore, uncontrolled flexing of the shoe, in particular uncontrolled torsional flexing of the middle part is to be prevented with such sole materials in order to avoid a reduction of foot comfort and early deformation of the upper part of the shoe. The solution of this problem consists, to the extent to which it is of interest in the present context, in that the generally flat inlay extends over the entire length of the shoe sole and all spikes of the forefoot region are attached to it, whereby the points at which the spikes are attached to the inlay consist in slight indentations. As a result, said stiffening inlay brings about not only the required transverse stiffening within the forefoot region of the shoe sole but the forefoot region is at the same time stiffened also in the longitudinal direction of the sole, as a result of which the roll-off motion of the shoe sole when running is, in undesirable manner, made more difficult.

From the U.S. Pat. No. 4,439,937 a stiffening metal inlay is known, which extends from the middle part of the forefoot region of the shoe sole rearward towards the rear end of the heel region and is intended to act as a support in the waist or instep region. The front part of the forefoot region of the shoe sole is, on the other hand, specifically free of the stiffening inlay, so that it remains vertically flexible, which is necessary for a good roll-off motion, but this has the disadvantage that with such a design the lateral stability is low.

Lastly, a molded sole made of soft elastic plastic or rubber materials with a tread-through-proof, hard elastic inlay, e.g. made from steel sheet, is known from the European patent application EP-A-44 549, said sole being intended primarily for safety shoes in the construction industry, which are intended to be safe against the penetration of nails through the sole of the shoe. The stiffening inlay, which in the embodiment that is of interest in the present connection extends over virtually the entire length of the shoe sole, is so designed and embedded in the shoe sole that the toe region for supporting a steel toe-cap and the waist region for supporting the joint of the foot are each directly below the insole, whereas, on the other hand, the remaining part of the forefoot region and the heel region of this inlay are recessed so as to enable them to be covered throughout with a layer of soft elastic sole material in order to ensure higher foot comfort in the ball and heel regions than if use is made of a stiffening inlay extending at all points directly below the insole. These recessed regions of the stiffening inlay are brought about by the material of the inlay being bent in steps, along bending lines at right angles to the longitudinal axis of the sole where there is the transition from the given heightened to the given recessed region. However, these bending lines do not modify the stiffness conditions of the inlay significantly, as a result of which the inlay causes virtually the same degree of sole stiffening in the transverse as in the longitudinal direction, thus impeding the roll-off motion of the shoe sole to the same extent to which the transverse stiffness is increased.

OBJECTS AND SUMMARY OF THE INVENTION

One object of the invention consists in particular in providing an inlay for the production of shoes, with which the risk of lateral snapping over of the foot and hence the risk of ligament tears and strains is as low as possible, and which, at the same time, enables excellent roll-off motion of the shoe sole as required for running, in conjunction with optimal stability.

Another object of the invention is to provide a shoe sole and a shoe, in particular a sport shoe, with these characteristics.

According to the invention, this object is achieved by providing an inlay for a shoe, wherein (a) said inlay extends at least within the forefoot region;

(b) said inlay comprises one piece of a hard plate material of uniform thickness;

(c) said plate material is formed with a profiling provided transversely to the longitudinal direction of the sole of said shoe;

(d) said transverse profiling extends at least throughout substantially the entire forefoot region of said inlay;

(e) said profiling has a cross-section consisting of periodically repeating cross-sectional profile elements, each of said cross-sectional profile elements comprising a ridge and a recess;

(f) wherein said plate material is a resilient plate material.

A shoe sole according to the invention is characterized in that it has an inlay according to the invention, which is preferably firmly connected with the sole, i.e. preferably by molding about said inlay a plastic material, by foaming, injection, casting or some other method, or by vulcanizing it into a plastic material, or by providing said inlay partly or completely with a sheath of cork; said plastic material or said cork forming at least a part of the sole or the entire sole.

Lastly, the invention provides for a shoe having a sole according to the invention with an inlay according to the invention.

Other objects and advantages of the present invention will become apparent from the following description:

The inlay according to the invention is made elastically resilient, as a result of which the shoe sole, time and again, substantially resumes, by itself, its initial position.

Preferably the hard, resilient material from which the inlay is made is selected from the group consisting of metal, plastic, steel and spring steel.

Lastly, the inlay according to the invention is pressure-stiff against pressure at right angles to the plane of the sole, which is very important because as a result point pressures due to the ground are distributed over the entire area of the inlay, so that pressures caused by small stones, unevennesses of the ground, etc., are not transmitted to the sole of the foot point-by-point.

Such an inlay according to the invention, which is excellently suited for sole and shoe manufacture as carried out in practice, combines in itself, in particular, the following advantageous characteristics:

(1) High lateral stability since transverse profiling confers to the inlay a high stiffness against bending in the direction of profiling, i.e. in the transverse direction of the sole, especially in the given roll-off region;

(2) very good vertical flexibility in the longitudinal direction of the sole, especially during the roll-off motion, since transverse profiling confers to the inlay low stiffness against bending at right angles to the direction of profiling and at right angles to the plane in which the profiling extends;

(3) high torsional capacity about the longitudinal direction of the sole from the heel to the large toe, since transverse profiling enables torsion of the individual transverse profiles in respect of one another, about an axis vertical to the individual profiles and in the plane common to the profiles;

(4) good pressure distribution owing to the stiffness against pressure of the hard sheet material of which the inlay is made, such as steel, since this hard sheet material distributes pressures acting from below over the entire area of the inlay;

(5) excellent resilience since the springy sheet material reverts, owing to its springiness, into its initial position, as a result of which a shoe sole provided with the inlay according to the invention resumes its original shape time and again.

The high lateral stability of the inlay according to the invention enables, in conjunction with the good pressure distribution, very flat construction of the shoe soles provided therewith, i.e. the production of thin soles without substantial tilting effect, since the tilting moment is, owing to the low thickness of the sole, as low as possible, and the moment of resistance to tilting is, owing to the high lateral stability, as high as possible, a high degree of foot comfort being achieved at the same time, since point pressures emanating from the ground are not transmitted point-by-point to the sole of the foot and the roll-off motion of the foot while running is facilitated, while, in addition, a thin layer of soft-elastic sole materials on the underside of the inlay is sufficient for adaptation to unevennesses of the ground (high stability).

Investigations have shown that such an inlay according to the invention made from spring steel withstands a minimum of 5 million alternating bending operations without any loss of shape, which means e.g. that the inlay remains stable and suitable for use for about 650 golf tournaments.

An inlay in the form of a one-piece, profiled sheet, in particular with a sole-shaped contour, can, on the one hand, be as such made efficiently and economically, while, on the other hand, it is also possible to integrate it efficiently and economically with the sole of a shoe.

The torsional capacity of the inlay from the heel to the large toe can, if required, be further increased by the inlay having, instead of transverse profiling, longitudinal profiling within the waist region and/or the heel region, said longitudinal profiling being in line with the longitudinal direction of the sole. Such longitudinal profiling in the waist region is also advantageous for supporting the joint of the foot.

Although, as already mentioned, it is preferable to design the inlay in such a way that it extends over substantially the entire area of the sole, it may in certain cases be also sufficient for the inlay to extend over substantially the entire width and/or over substantially the entire length of the forefoot region, since this alone yields most of the advantages explained above, or that the inlay is sculpted by being recessed in predetermined regions.

The hard, resilient sheet material may have a thickness between 0.1 mm and 1.5 mm, and preferably between 0.3 mm and 0.8 mm.

The transverse and/or longitudinal profiling may have, in particular, a grooved, fluted, ribbed, channelled, undulating, furrowed or bead-shaped, and preferably a corrugated, trapezoidal, zig-zag-shaped or corrugation-like cross-section.

In this connection profiling direction means the direction in which such profiling is rolled, drawn, extruded, etc., i.e. in case of profiling with grooved cross-section the longitudinal direction of every individual groove, etc.

Preferably the ridge has the same width as the recess of said profile cross-section elements.

The width of the periodically repeating profile cross-section elements is preferably 3 mm to 20 mm, more especially 6 mm to 16 mm, and by way of special preference 8 mm to 13 mm.

With a view to increasing the anchoring capacity of the inlay in a sole further, it is possible to design the transverse and/or the longitudinal profiling in such a way that it is, in the profiling direction, undulating, serrated, grooved, fluted or furrowed, or has some other secondary profiling at right angles to the direction of profiling, although owing to profiling the inlay according to the invention already has excellent anchoring capacity and such an increase is not required in most of the cases.

For the pressure of the foot to be transmitted to the ground even better, the inlay, especially if it is a one-piece sheet, can be provided, within a predetermined region of the foot or in several predetermined regions of the foot, with a recess in the direction of the ground, preferably within the range of the large toe, of the ball of the foot and/or of the heel, whereby said recess has, preferably, a flat or plane bottom, so as to enable the above function to be carried out particularly well.

In order to ensure that, in the course of foaming in etc., the plastic can spread well on both sides of the inlay, the latter can be provided with through-holes for the plastic material, said holes being distributed over the surface of the inlay, and preferably provided with one or several injection ducts through which to inject the plastic material, and/or with a multitude or plurality of penetration apertures or smaller through holes, which may, in particular, be penetrations.

The inlay according to the invention makes it outstandingly possible for knobs or spikes to be fitted in a non-separable manner or to be replaceably fitted by means of fastening means provided on or within the inlay. This virtually eliminates all attachment and fastening problems, which otherwise occur when fitting knobs or spikes to a normal sole.

As a point of detail, the above fastening means may be threaded holes provided within the inlay or threaded inserts mounted on the inlay. Particularly stable, especially directionally stable, attachment of knobs or spikes to the inlay can be brought about, according to the invention, by the foot sections of the knobs or spikes or the fasteners such as e.g. threaded inserts being secured within recesses in the inlay and supporting themselves against the side walls of the recesses, that they match the adjacent side walls of the recesses, preferably in positive manner, and/or are firmly attached to said side walls, whereby said recesses are preferably the profile recesses produced transverse and/or longitudinal profiling. The spikes can also be secured in other ways, e.g. by riveting or welding.

The inlay according to the invention may also consist of a composite sheet material comprising several layers joined with one another so as to produce an integrated composite structure, at least one of said layers being provided with the transverse profiling and preferably consisting of the transverse profiling. Such a composite structure makes it possible to link the advantages of different materials.

Although the inlay according to the invention can in principle also be used as an "inlaid sole" or inlaid intermediate sole, it is preferable to develop it as an insole or join it firmly with the sole, in order to integrate it, in stable fashion, with the overall structure of the sole and hence the entire shoe, this being possible both by bonding to the sole or vulcanizing onto or in the sole, as also by molding the sole material about the inlay.

The inlay according to the invention can be developed in accordance with the invention as an insole in that the profiling cavities and/or intermediate spaces of the transverse profiling and the longitudinal profiling optionally provided in certain embodiments and other recesses or the like are filled by a filler material preferably firmly connected with the inlay in such a way that inlay and filler material, e.g. plastic or cork, are preferably combined to give a composite material whose upper and/or lower surface is plane.

The invention furthermore provides a sole for a shoe having an inlay according to the invention which is firmly connected with the sole or forms a component of the sole or in which the sole is an insole of the above-mentioned kind or is firmly connected with such an insole. In such a sole according to the invention a plastic may be foamed, injected, cast or molded in any other way about the inlay or the inlay may be vulcanized or sheathed into a plastic or cork material, this plastic or cork material forming at least part of the sole or the filler composition or the entire filler composition and sheathing said inlay partly or completely.

The inlay, insole or sole according to the invention is suitable for shoes of virtually any kind, whereby the concept "shoes" within the scope of the present invention and claims relates, apart from shoes in the narrow sense such as low shoes, high shoes, sport shoes, e.g. ski shoes, golf shoes or the like, etc., also to boots, in particular high boots, rubber boots, etc. Incidentally, by using the inlay, insole or sole according to the invention the shoes can be produced very economically. Apart from the above advantages, the high lateral stability of the inlay, insole or sole according to the invention causes all shoes to be supported and the plantar arch to be protected while at the same time protecting the ball region, in particular against burn when running, while the elastic resilience of the inlay ensures, inter alia, that the foot is less prone to fatigue.

The inlay, insole or sole according to the invention is advantageous for normal shoes such as street or running shoes, and it is particularly advantageous for sport shoes such as, in particular but by no means exclusively, shoes for light athletics, jogging shoes, shoes for indoor sports, sport shoes for lawn sports, golf shoes, tennis shoes, high-jump shoes, mountaineering shoes, ski shoes, etc., while owing to the outstanding characteristics which it confess to the shoe, its effects are not only such as to make it more useful and protect health but also such as to increase performance, whereby said effects result from the various characteristics such as increased stability, torsional capacity, elastic resilience, etc. In the case of golf shoes for instance, to mention but one example, the quality of the strokes is, inter alia, improved owing to improved stability, high roll-off mobility and good torsional capacity. In the high jump it is possible, as has been shown by tests, to achieve greater heights, particularly by the resilience of the inlay. With mountaineering shoes the transmission of pressures from below, which in this case is particularly critical owing to the ground conditions such as slopes of boulders, is reduced to a very substantial degree, while owing to the fact that the flat sole construction is possible, the close contact with the ground is, at the same time, considerably improved and the danger of injuries to the feet significantly reduced. This significant reduction of the risk of injury and improvement of close contact with the ground is, incidentally, a very important advantage of the invention whatever the type of sport.

The invention also provides further developments of the above inlay which will be called here "the basic inlay" and which extends over the front of the foot, the rear of the foot, or over the full extent of the sole of the foot, or only extends over parts of the sole. This inlay is also suitable for a widely differing range of shoes, such as walking shoes, sports shoes, boots, sandals, high-heeled sandals, gym shoes, and the like.

Said further developments according to the invention can in general have all features of the basic inlay as long as these features are not excluded by the features according to these further developments in each of their forms.

The particular object of these further developments is to fashion an inlay and a shoe provided with an inlay of this type in such a way that there is no significant impairment of the applicable bio-mechanical and physical laws during walking or running when wearing the shoe, and moreover wherein these laws are preferably even supported and promoted by the effect of the inlay, so that an inlay is preferably provided which is largely compatible with these bio-mechanical and physical laws, the use of which as a sole results in shoes which in practice lead to conditions corresponding to the best possible application of these laws.

The purpose of a shoe is to guide and support the foot, to damp out shocks which occur, and to act as a tool for the foot. Thus, a multiplicity of purposes exist, which cannot all be fulfilled in the optimum manner by one shoe. This can be seen from the fact that there are many different types of shoes for different purposes. Thus, there are climbing boots, shoes for indoor sport, tennis shoes, shoes for javelin throwing, ski boots, boxing shoes, football boots, golf shoes, and many others as well.

Problems in shoe design and manufacture were discussed in depth at the First International Symposium on Sports Shoes, which was held in Munich 1984. Speakers from various specialist disciplines tackled the problems of the shoe in relation to the bio-kinetic and dynamic requirements for special types of loading, particularly the loadings associated with various types of sport. The results obtained from this led to specific shoes for different types of sport; there was no comparison at all between these different types of shoe.

Although the above basic inlay or an insole containing such basic inlay has many advantages, it can be further developed by taking into account many characteristics of the biomechanical laws, particularly the specific loadings for different types of sport.

The particular object of the following further developments is therefore to provide an inlay and its use as a sole which is fashioned in specific regions in such a way that loads are supported which are specific to different type of sport and/or which are determined by the foot, and which are not or not fully supported by the above basic lay or a sole or shoe provided therewith.

This object is achieved by providing an inlay of the basic type described above and its application, wherein the inlay has one or more of the following characteristics (a) to (g):

(a) recesses are provided at the outer and/or inner side of the inlay;

(b) the inlay has recesses cut out and/or a profiling provided in the region of the heel;

(c) the inlay is sculpted by being recessed in predetermined regions;

(d) the inlay comprises elements which are separated from each other and which are firmly attached to each other with a torsion bar or otherwise;

(e) the transverse profiling runs substantially or approximately at right angles to the line of the points of application of force or comprises several regions of different slant to the longitudinal axis of the inlay or sole, the transverse profiling runs at a special slant angle relatively to the longitudinal axis of the inlay or sole;

(f) slits are provided in the region of the sole, particularly in the region of the forefoot;

(g) one or more damping elements are incorporated into the region of the heel part of the inlay and/or the part of the forefoot region, or one or more recesses are provided to receive damping elements.

These characteristics (a) to (g) will now be described in more detail.

Although the basic inlay enables the foot to achieve a firm, positive contact with the ground, this firmness can, however, adversely affect the shoe, and often means that the loads specific to different types of sport cannot be supported. It is true that by the basic inlay an outward tilting moment—which leads to the tilting of the foot outwards and thus facilitates injury to the outer ligament assembly—is prevented. However, this basic solid spring steel inlay or insole favors an outward tilt of the foot in such cases in which the foot is enlarged by the increase in the radius from the ground to the midpoint of the lower ankle joint, due to the stability towards transverse bending when the foot is tilted on its outer or inner side. The foot inside the shoe is then tilted by the hard sole and a maximum point of a curve is thus reached, which promotes toppling over if the labile equilibrium is exceeded, and leads to the risk of damaging or tearing the ligaments on the inside or outside of the ankle joint.

This is prevented by means of the invention in that in a further development of said inlay recesses are provided at the sides of the inlay corresponding to the inside or the outside of the foot. Flat parallel tongues are preferably formed by the recesses; these point inwards or outwards in the direction of the profiling. These flat parallel tongues are preferably pre-bent and/or preferably have a predetermined bias or initial stress, which can be directed either towards the foot or towards the ground. Moreover, the arrangement can be such that the width and/or the depth of the recesses are different and/or the number of recesses on the inner and outer side of the foot are different.

This structural alteration achieved according to the invention can significantly reduce the tilting moment which acts outwards, as long as only a part of the inlay is stamped out from the profiling of the inlay, particularly from a meandering profiling structure, where this part which is stamped out is either plane or increases or decreases up to the inner side or the outer side of the shoe, and depending on the type of sport, the remaining part preferably measures 1 to 2 cm, i.e. that part which is partly stamped out and only has said flat parallel tongues. This stamping out procedure can even result in only a narrow web remaining in the central region of the inlay. This still confers stability on the inlay, an insole containing said inlay or an inserted sole comprising said inlay, but reduces the stability towards the side of the shoe and provides the wearer of the shoe with a better adaptation to the ground by the flexure of the outer or inner edge of the inlay, particularly in a spring steel inlay.

A damping effect is also achieved by this means, and use is made of the tendency of the flat parallel tongues which are on the inner and/or outer side of the inlay, particularly in a spring steel inlay—to straighten out again and to transfer their bending energy to the ground. An upward or downward swinging moment is also ensured.

The inward and/or outward facing flat parallel tongues of the inlay, which is provided with the above-mentioned recesses by stamping them out, do not strictly need to reach as far as the outer edge of the sole of the foot, but on the other hand can still run across the outer edge of the foot and go beyond the standing surface of the sole of the foot in certain regions, depending on the loading for each specific type of sport.

In particular, this further development of the inlay is of enormous importance for all types of sport where the playing surface is flat, but for which rapid changes of direction are necessary, for example, for tennis shoes or basketball shoes.

The inlay can therefore have a central region with the normal shape according to the basic inlay whilst being flexible in the transverse direction at its edges due to the flat parallel tongues. This leads to the consumption of energy and therefore to a damping effect. The distance from the point of contact with the ground to the maximum of the curve in the region of the upper or lower ankle joint is also reduced by this flexure.

Moreover, as stated above, the inward and/or outward facing flat parallel tongues can be pre-bent and can have a bias or an initial stress before they enter a shoe, e.g. as parts of an insert or insole. When pressure is exerted on the ground by the loading foot during the support phase, the flat parallel tongues which are pre-bent downwards are distorted and produce a damping effect. When the foot wearing the shoe jumps or leaves the ground, this distortion energy is transferred to the wearer of the shoe again in the form of a trampoline effect; the effect of this is to accelerate the wearer's running process.

On the other side, however, the flat parallel tongues can also be bent upwards, which causes a tension or stress. This is of particular application when no significant damping effect is required from the outward facing tongues, but instead only the optimum adaptation of the foot and the optimum pressure distribution are required. The flat parallel tongues, which are pre-bent upwards here, can be built into a solid insert or insole so that rapid changes of direction are facilitated, without the shoe forcing the foot into complete contact with the ground too much. The possibility of the final force being achieved by standing on the inner or outer side of the foot is not prevented by these flat parallel tongues which are pre-bent upwards; rather, the stability of the shoe is in no way put at risk, and the foot remains fully capable of making contact with the ground.

This again favors a significant improvement in the contact between the foot or the shoe and the ground and a significant reduction in the risk of injury when rapid changes of direction are made, in volley-ball for example. All these properties can be combined in one shoe by using flat parallel tongues which are pre-bent upwards as well as flat parallel tongues which are bent downwards.

A major problem when considering the loading of the foot is the problem of overpronation. This has been interpreted in different ways and is the subject of several scientific investigations. The problem of overpronation is a normal problem in the human foot or the human body. Pronation is understood to mean the inward movement of the foot when it arrives on the ground; this pronation process has a normal damping effect, and results in the heel undergoing a transformation from an O-position to an X-position. This process is limited as a dynamic process by the musculature attached to the foot. When running using the heels, the pronation alters on altering the distance between the perpendicular passing through the center of the lower ankle joint and the lower support surface and the point of contact of the heel.

For a foot encased in a shoe, this distance is much greater, due to the foot being distanced from the floor by the heel on the shoe. The pronation thus alters, and the angular acceleration becomes greater since the lever effect is greater, so that for the same force of engagement a much greater moment is exerted on the foot than when running in bare feet. The angular acceleration from the O- to the X-position becomes significantly greater, and the opposing muscular control must be greater, since a much greater force acts on the lower leg and the foot due to the increased leverage. This leads to the phenomenon of overpronation, with a multiplicity of traumatic orthopedic consequences such as irritation of the Achilles tendon, tibial edge syndromes, compartmental syndromes, fatigue fractures, disorders of the patella, and irritations of the sacral joints.

The overpronation caused by the shoe is mainly attributable to a sole which is too thick in the region of the heel. Furthermore, spoiler heels, which are provided for damping the shock which occurs, can increase the pronation. The advantage of the basic spring steel inlay or insole comprising it, is that the heel can be made lower. However, the disadvantage of the heel being adjacent to the ground in this way is that no energy-absorbing mass can be built in to provide damping. To incorporate this, the heel must be positioned higher again, which purely on the basis of mechanical considerations can lead to the phenomenon of overpronation. Moreover, the basic inlay or sole extends to the outer edge of the shoe, and is flat. To achieve the requisite transverse stability, this inlay or insole made of spring steel cannot adapt to the spherical shape of the heel on when the side of the heel contacts the ground. A lever effect is once again exerted on the heel due to the flat, stable arrangement of the heel part of this inlay or insole; this can lead to the phenomenon of overpronation.

This problem is overcome according to a further development of the invention in that the inlay has radial recesses cut out and/or a radial profiling in the region of the heel. If no radial profiling is provided, the inlay can be shaped so that it is flat in the heel region. The remaining flat radial tongues of the inlay left after cutting out the recesses in the region of the heel can be star-shaped or lath-shaped, and are preferably wider at their free ends. Moreover, the flat radial tongues of the insert left after cutting out the recesses can be connected to each other by means of one or more webs.

The following particular advantages can be achieved by means of this further development of the inlay according to the invention, particularly when the inlay is made of spring steel:

The inlay or rigid sole can be flat in the region of the heel and does not have a transverse profiling there. Radial cut-out elements are removed from the insert by stamping; these run from the mid-point of the heel outwards, so that lath-shaped flat radial tongues, particularly radial spring steel tongues, remain at the outside of the heel and at the rear of the heel. These lath-shaped flat radial tongues do not mutually obstruct each other, however they can become distorted on contact with the ground and can therefore act to absorb energy. On pushing off, these lath-shaped flat radial tongues are extended again, so that the energy transferred from the bending process can be transferred to the wearer of the shoes again, and the insole thus acts to accelerate the running process. The advantage of this structural further development according to the invention is that the runner or walker can make contact with the ground in the region of the heel in a way which provides the optimum control, due to the bending of the flat radial tongues or other radial elements of the inlay in the region of the heel. This is because the distance from the point of contact to the perpendicular through the center of gravity of the lower ankle joint is kept small, the heel part of the shoe can distort without appreciable force being required, and thus the point of contact with the ground is brought up to the human heel. Thus, the hard inlay or insole, particularly when it is a spring steel inlay, adapts to the spherical shape of the heel. The heel is not levered into overpronation, but instead the foot can develop a loading which approaches that of running in bare feet.

Since these radial laths or tongues or other radial elements preferably do not exist on the inner side of this heel portion of the inlay which has the novel arrangement according to the invention, as they are not required there, harder cores can be incorporated in this region, in an attempt to prevent the tendency towards excessive pronation. A damping process is also achieved due to the distortion of the lath-shaped flat radial tongues or other cut-out elements, particularly spring steel elements, which are preferably cut out grouped around the mid-point of the heel bone at the contact point of the latter with the ground. The stored energy is transferred to the runner again when he springs off. These lath-shaped radial spring steel wedges or other radial cut-out elements can also be pre-bent towards the ground here, with a bias or an initial stress incorporated during manufacture, so that a trampoline effect can again occur here, which imparts additional rebound energy to the runner or walker when the shoe is lifted from the ground.

Another further development of the basic inlay, particularly made of spring steel, is provided, wherein the stamped out radial elements are not lath-shaped but star-shaped tongues, and are formed as triangular shapes with their apexes pointing outwards. The center of these radial star-shaped ribs or flat tongues is again preferably in the region of the center or midpoint of the heel according to the pattern of the insole. The heel around the region of the heel point of an inlay or insole can be fashioned according to the invention so that a transverse profiling does no longer exist here instead this can be fashioned flat or can be stamped star-shaped or in the form of meanders. Moreover, depending on the requirements, the radially outward pointing ribs or flat tongues can still be connected with narrow webs which influence the damping process. Furthermore, the pointed radial star-shaped ribs or the flat radial tongues can have e.g. club-shaped, wider regions or similar extensions at their outside, so that foam-based material on the side of a shoe is protected, and the uptake of the load is distributed better on loading.

A still further development of the basic inlay consists of sculpting the inlay so that it is recessed in predetermined regions. In particular, the inlay can be recessed in the region of the ankle joint of the foot, and/or recesses can be provided in the central region of the inlay to receive special components of the sole, insole or upper. Moreover, the outline of the inlay can be smaller than the outline of the corresponding insole; in particular the outline of the inlay can be smaller all round than the outline of the corresponding insole.

In particular, this sculpting according to the invention can comprise a deep recess in the region of the so-called central part or ankle joint part of the inlay. The wide ankle joint part prevents free torsion between the rear of the foot and the front of the foot. If the central part or the so-called ankle joint part of the inlay is fashioned so that it is narrower, the torsion of the rear of the foot is not fully transmitted to the forefoot or the torsion is restrained and does not lead to the foot being subjected to an abnormal or pathological load. The forefoot and the rear of the foot can twist with respect to each other in relative isolation. The movements which are specific to running are supported by the advantages of an energy-absorbing heelpiece and the advantage of the reduced transfer of torsion from the rear of the foot to the forefoot, or the advantage of the forefoot and the rear of the foot being loaded in isolation.

A significant development of this concept consists of an inlay which comprises elements which are separated from each other, and which are firmly attached to each other in the region of the ankle joint by means of a torsion bar or in another way. In particular, the inlay can be divided into two parts, so that the inlay then only consists of a region at the forefoot and a region at the rear of the foot. This inlay, particularly an inlay made of spring steel, can be firmly riveted to a torsion element. The advantage of this inlay according to the invention is that, in contrast to the prior art, where the torsion element was mounted into polyurethane foam or a similar material which was not extremely hard, it can now be riveted to a hard material which does not permit the torsion element to be torn out.

Yet another development of the basic inlay, particularly an inlay made of spring steel, is that, as stated above, the inlay does not extend over the whole foot contact region with the ground or over the whole surface of the foot, but instead the outward pointing flat parallel tongues at the outside and/or inside of the inlay, which are shaped according to the invention, are only present in a few regions. Thus, a skeleton inlay of a sole is formed, particularly a spring steel skeleton, which can be covered with foam. This skeleton can then provide better support to certain positions of the foot. It is thus possible to keep the region of the outside of the heel and the rear of the heel free of the inlay; the region of the balls of the big toe and the little toe can likewise be kept free, and the bridge between the second, third and fourth central foot joints can be supported by the inlay, thus preventing slippage of the front transverse arch. Thus, from an orthopedic point of view the inlay is formulated as a supporting inlay for certain points of the foot, and would correspond to the requirements of orthopedic technology and orthopedic medicine.

A still further development of the basic inlay, particularly an inlay made of spring steel, is that the transverse profiling runs substantially or approximately at right angles to the line of the points of application of force, or comprises several regions of different angles of slant to the longitudinal axis of the inlay. Further details of this will now be given:

When running on the ground, a force of reaction from the ground arises. The sum of the forces of reaction from the ground falls on a line called the "line of the points of application of force". This runs with a wave-like trajectory from the point of contact with the ground over the mid-point of the heel in the region of the outer edge of the foot, from there to the mid-point of the ball of the foot, and from there to the big toe or the second toe. The line of the points of application of force is altered by means of a relatively rigid basic inlay, particularly an inlay made of spring steel, with flat ribs or other profiling, and the foot is placed in an awkward predicament.

The corresponding further development of the basic inlay is fashioned according to the invention so that the profiling of the inlay runs substantially or approximately at right angles to the line of the points of application of force, and not at right angles to the longitudinal axis of the sole. This profiling must not run along the line through the perpendicular to the center of gravity, but should run approximately at right angles to the line of the points of application of force, because the forces of reaction from the ground can then be most reliably transmitted to the foot or from the foot to the ground. This again has an accelerating effect on the runner's foot.

The invention further provides an optimal force transmission between the foot and the ground by providing the transverse profiling at least in the forefoot region of the inlay such that the transverse profiling runs at an acute angle from between 70° to 86° to the longitudinal axis of said inlay, wherein said angle is defined as the angle between the direction of the transverse profiling which from said longitudinal axis runs to the outer side of the sole of said shoe, and the branch of the longitudinal axis which runs from the point of measurement of said angle towards the heel of the sole of said shoe. More preferably, this acute angle is between 74° and 77°.

Furthermore, in the rear foot region there is obtained optimal force transmission between the foot and the ground by providing the transverse profiling of the inlay in this region such that it runs at an obtuse angle from between 95° to 120° to the longitudinal axis of said inlay, wherein said angle is defined as the angle between the direction of the transverse profiling which from said longitudinal axis runs to the outer side of the sole of said shoe, and the branch of the longitudinal axis which runs from the point of measurement of said angle towards the heel of the sole of said shoe. More preferably, this obtuse angle is between 100° and 115°.

One problem which arises during the normal manufacture of shoes is that of fixing the heelpiece, which stabilizes the rear of the foot. One further novel structural arrangement of the part of a shoe at the rear of the foot can be obtained by means of the inlay according to the invention, particularly an inlay made of spring steel. In addition to providing the inlay with star-shaped radial ribs or star-shaped or lath-shaped radial flat tongues or with parallel flat tongues with recesses at the point of contact of the heel whilst retaining only a central spring steel sheet, a heelpiece which is likewise preferably made of spring steel can be welded or riveted to this inlay or can be fastened in another way so that it is then firmly attached to the inlay or insole.

In this respect, it must be ensured that this heelpiece is recessed or can be recessed in the region of the Achilles tendon or in the region of the point of contact. Moreover, the hard or steel external heelpiece, which is riveted to the basic inlay or sole, can be kept low or even dispensed with, so that there is no lever effect acting on the heel. The internal heelpiece can be made high and wider at the front, however. By covering this hard heelpiece with a foamed cushioning material, the wearer of the shoe can be protected from excessive pressure. The heelpiece which is fastened on, particularly by riveting, can then enclose the heel region in the shape of a hollow. This type of heel fixing could also relate to only a part of this modified spring steel inlay according to the invention, namely the region at the rear of the foot. The heelpiece can also be fastened to an inlay made of another hard, elastic material than spring steel.

Another further development of the basic inlay consists in that the inlay, particularly a spring steel inlay, is riveted or firmly fastened in the region of the forefoot, especially in the region of the toes, to a toecap or cap covering the front of the foot, which is likewise preferably made of spring steel, so that this cap protects the forefoot. The object of this arrangement according to the invention is to keep articles which fall onto the ground away from the forefoot, and to protect the forefoot and the toes. This toecap made of metal or another hard material can be incorporated as a fixed component in a shoe. However, it can also be incorporated in an inlay which in turn is incorporated in a corresponding boot or shoe, for example a rubber boot.

Still another development of the basic inlay, particularly an inlay made of spring steel, comprises the provision of a longitudinal slit in the region of the forefoot and the middle of the foot, to reduce the stiffness in the region of the forefoot or the middle of the foot. These partial regions with longitudinal slits allow the forefoot and the middle of the foot each to sink in more deeply or to be individually supported, in accordance with orthopedic requirements. In this arrangement the inlay or sole is more flexible in the region of the forefoot without any significant loss of stability. The requirements of orthopedics technology can thus be complied with. For example, this would be advantageous for an angler's boot or shoe, where the angler steps on to a river bed, placing his foot on unknown and uneven ground; the movable, hard spring steel inlay or sole would be better adapted to this requirement. Furthermore, more detailed consideration can be given to the individual arrangements of the wearer's foot in this inlay or sole. This inlay, which was formerly rigid, would be deprived of part of its rigidity to facilitate better adaptation of each individual arrangement of the foot.

Basically, slits running parallel to the direction of the profiling and/or slits running at right angles to or otherwise transverse to the direction of the profiling can be provided.

Another development of the basic inlay comprises the incorporation of special damping elements. As explained above, a pronating movement is executed on making contact with the ground, which is stronger for a foot wearing a shoe than for a bare foot. The braking process comes from the muscles. This braking process can be supported by the present arrangement of a hard inlay according to the invention.

In specific cases a spring, particularly a steel spring, which opens out towards the inner side of the foot can be riveted to the underside or the upper side of the hard inlay. Damping elements, i.e. elastically deformable material pieces or other damping elements, of widely different forms (for example, air, gel, etc.) can be accommodated in this opening. On the leverage on the foot during pronation the inner part of the heel portion is subjected to an increased loading. The damping element incorporated in this region can absorb impact energy by becoming distorted and elastically deformed, and it can transfer this energy to the wearer when the heel leaves the ground.

A further measure according to the invention is to fasten a leaf spring above or below the inlay, where the leaf spring extends on loading and thus absorbs energy. Penetration of the heel part would not be possible, due to the hard form of the inlay.

The inlay according to the invention can be used as an insole or as a component of an insole; or as an inserted sole or as a component of an inserted sole; or as a sole reinforcement which is firmly attached to a sole or to a shoe.

BRIEF DESCRIPTION OF THE DRAWINGS

The above and further objects, advantages and features of the invention are described in more detail below by means of some preferred embodiments of the invention, with reference being made to the attached drawings which illustrate such embodiments of the invention, where:

FIG. 4 is an excerpt from a rectangular corrugated profile which may be provided by way of profiling in various embodiments;

FIG. 5 is an excerpt of a trapezoidal corrugated profile provided with secondary profiling;

FIG. 6 is an excerpt of a zig-zag profile provided in the embodiments according to FIG. 3 and FIG. 7;

FIG. 7 is a fourth embodiment of a basic inlay according to the invention which is provided with transverse profiling only in the forefoot region but has a torsional bridge with transverse profiling and/or longitudinal profiling in the waist region (in the present case profiling is provided in the waist region, which extends in longitudinal direction of the torsional bridge extending at an acute angle to the longitudinal direction of the sole) and is provided with longitudinal profiling in the heel region, furthermore through-holes are available for attaching spikes;

FIG. 25 shows flat parallel tongues which are pre-bent downwards towards the ground;

FIG. 26*a* shows a two-piece inlay with a torsion element;

FIG. 26*b* shows an inlay according to a further development of the invention with a transverse profiling, the direction of which is substantially at right angles to the line of the points of application of force;

FIG. 32 is an oblique view of an inlay according to a further development of the invention with a damping device, of which only the spring can be seen; this forms one part of the damping device;

FIGS. 33*a* and 33*b* are each sections along the line A–A ' of FIG. 32, which shows the damping device in two extreme configurations;

FIGS. 34*a* and 34*b* are section views of an inlay provided with a leaf spring as a damping element, for two extreme configurations of the leaf spring;

FIG. 35 shows another arrangement of a damping element on an inlay according to a further development of the invention;

DESCRIPTION OF THE PREFERRED EMBODIMENTS

Figure 1:
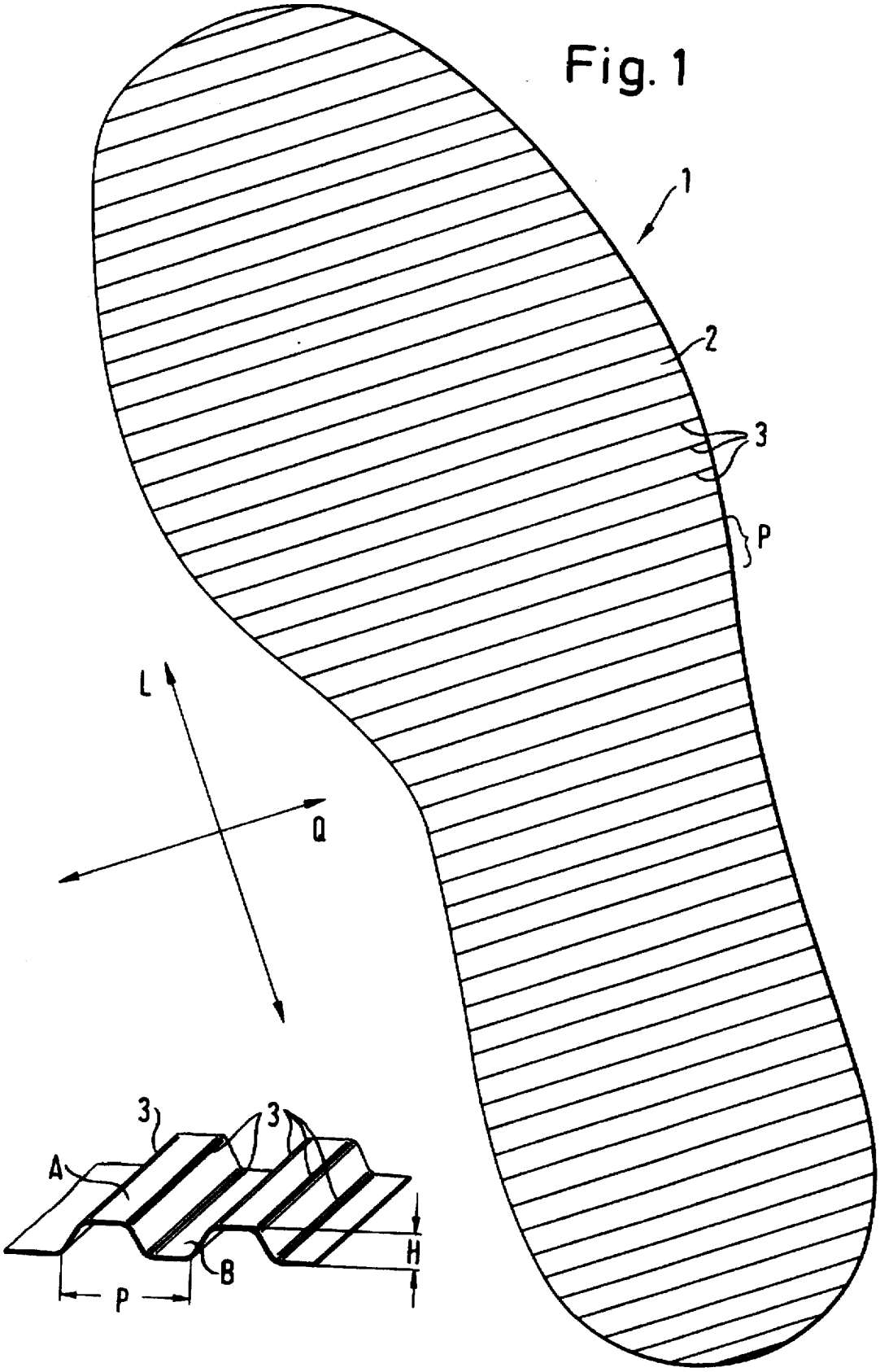
FIG. 1 is a top view of a first embodiment of a basic inlay according to the invention, which extends over the entire area of the sole and is provided with transverse profiling throughout (e.g. at a scale of 1:1 with shoe size 42), as well as an enlarged partial view in perspective of the transverse profiling.

In some Figures of the drawing identical or similar components bear the same reference numbers so that as regards such components which bear a reference number in a Figure but are not explained reference should be made to the explanations of these parts as given in relation to previous Figures.

To begin with, reference is made to FIG. 1 showing a top view of a first basic embodiment of an inlay 1 according to the invention. This inlay is made in one piece of hard, resilient sheet material, i.e. preferably spring steel, and extends over the entire area of the sole, that is to say its contour is substantially that of an insole, as shown.

Inlay 1 is provided on its entire surface with transverse profiling which extends in transverse direction Q of the sole and at right angles to the longitudinal direction L of the sole. In the left-hand bottom part of FIG. 1 there is a partial view in perspective of said transverse profiling 2. According to this view said transverse profiling has a trapezoidal corrugated profile with rounded profile edges. These profile edges 3 are drawn in FIG. 1 in order to characterize the profile direction and the profile period P, whereby the distance between two profile edges 3 in FIG. 1 corresponds to half a profile period ½ P since the flanks of the trapezoidal transverse profiling 2 deviate only slightly from the vertical so that the two profile edges 3, each of which limits one profile flank, coincide in the top view of FIG. 1 so as to form virtually a single line.

It will be appreciated that in FIG. 1 and also in the other Figures only some of the profile edges shown bear a reference number.

As can be seen in FIG. 1, the term "profile period" signifies the width of the periodically repeating cross-sectional profile elements, i.e. in this case the width of a trapezoidal ridge A plus a trapezoidal recess B.

Figure 2:
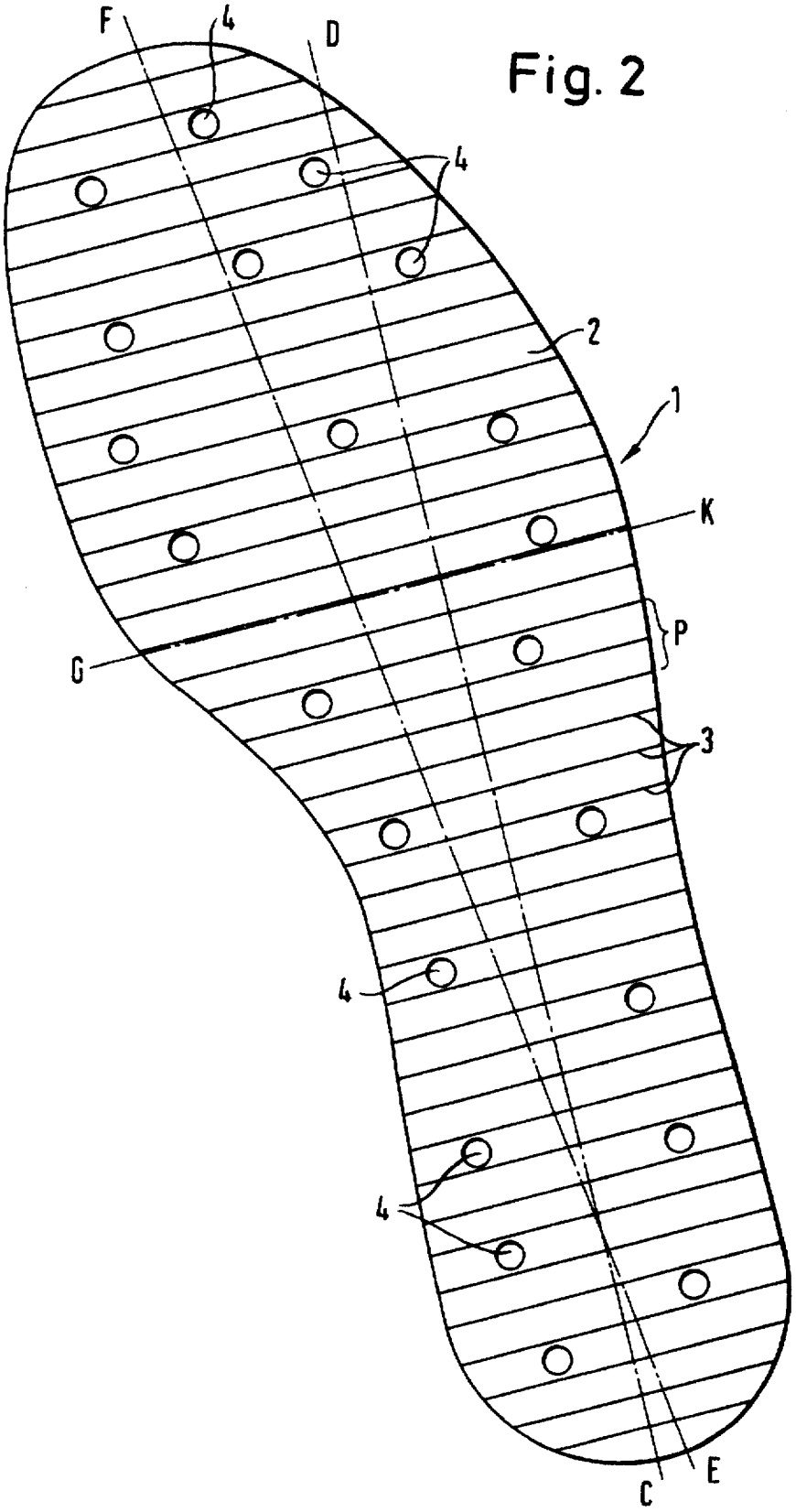
FIG. 2 is a top view of a second embodiment of a basic inlay according to the invention, which is similar to the embodiment shown in FIG. 1, in which however the transverse profiling is characterized by a somewhat larger width of the individual profiles and is provided with through-holes for plastic serving to coat the inlay as it is embedded into a sole with foam or to encase it in some other manner.

FIG. 2 shows a further basic embodiment of an inlay 1 differing from the inlay according to FIG. 1 substantially by the fact that the profile period P of the transverse profiling 2 is larger and that the inlay is provided with through-holes 4 designed, in particular, as penetrations. These through-holes 4 distributed over the surface of inlay 1 serve as through-holes for plastic material when molding, by foaming, injection, casting or some other method, plastic about the inlay with a view to integrating the inlay into a shoe sole.

In addition, the longitudinal axis C-D, the roll-off axis E-F and the transverse axis G-K of the sole, into which inlay 1 is integrated, are drawn in FIG. 2.

Transverse profiling 2 of inlay 1 according to FIG. 2 has preferably the profiling form shown at the bottom of FIG. 1, but any other profiling form is also possible, for instance one of the profiling forms shown in FIGS. 4, 5 and 6.

Figure 3:
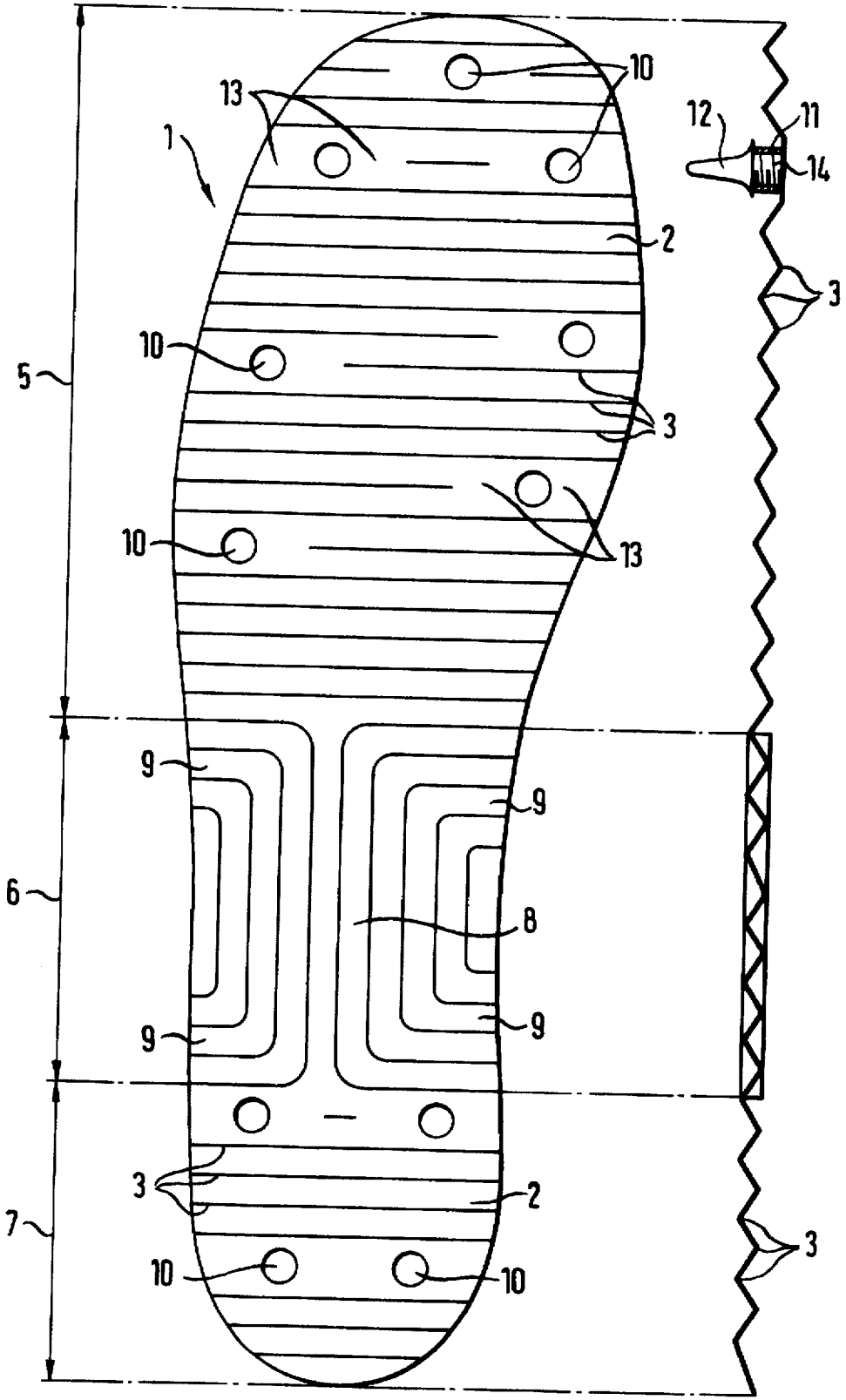
FIG. 3 is a top view of a third embodiment of a basic inlay according to the invention as well as a cross-section through said inlay, which is similar to the embodiment according to FIG. 1, but differs from said embodiment in particular in that it has through-holes for fitting spike fasteners and in that, in the waist region, the transverse profiling partly passes over into longitudinal profiling.

FIG. 3 shows a top view of a third embodiment of inlay 1 according to the invention as well as a longitudinal section through this inlay which differs in various ways from the embodiments according to FIGS. 1 and 2;

(a) Whereas both in forefoot region 5 and heel region 7 transverse profiling 2 is provided, waist region 6 is provided with longitudinal profiling 8 extending in the longitudinal direction of inlay 1, whereby said longitudinal profiling passes at the two longitudinal ends of heel region 6 via transitional transverse profiling 9 gradually into transverse profiling 2 of forefoot region 5 and heel region 7.

(b) Transverse profiling 3 as well as longitudinal profiling 8 and also transitional transverse profiling 9 can be designed as a zig-zag profile, as shown in the cross-sectional view of FIG. 3. A partial view of this profile is shown, in perspective manner, in FIG. 6.

(c) Lastly, inlay 1 of the embodiment according to FIG. 3 has through-holes 10 for the attachment of threaded lugs or inserts 11 for screwing in knobs or spikes 12 (see FIG. 3, right, top). So as to be able to attach the threaded lugs or inserts 11 with a wide base 14 in a particularly stable manner to inlay 1 in FIG. 3, flat regions 13, i.e. regions without transverse profiling 2, are provided about through-holes 10. The method of attaching knobs or spikes described in the specification is only one example for the numerous ways in which these can be attached both permanently or detachably to the inlay according to the invention.

As already mentioned, FIGS. 4, 5 and 6 show partial perspective views of profiles which can be used instead of the profile shown in FIG. 1, bottom left, by way of transverse profiling 2 and/or longitudinal profiling 8 as well as possibly transitional profiling 9. In this connection it should be noted that the profiles shown are only a few profiles of a multitude of all kinds of profiles suitable for the inlay according to the invention.

FIG. 4 shows in particular a rectangular corrugated profile, whereas FIG. 5 shows a trapezoidal corrugated profile with secondary profiling 15, which is smaller than the trapezoidal corrugated profile and has the profiling direction at right angles to the profiling direction of the trapezoidal corrugated profile. FIG. 6 shows, as already mentioned, a zig-zag profile. Profile edges 3 may be rounded to a greater or lesser extent so that the profiles according to FIGS. 4 and 6 can in consequence pass into grooved profiles with grooves of half-round or oval or arch-shaped cross-section, if this is required.

Profile period P is preferably in the range between 3 mm and 20 mm, more especially in the range between 6 mm and 16 mm and by way of special preference in the range between 8 mm and 13 mm, whereas profile height H is preferably in the range between 1 mm and 5 mm, more especially in the range between 2 mm and 3 mm, the hard resilient sheet material of which inlay 1 is made consisting preferably of resilient metal or plastic material, and, by way of special preference, of spring steel. The thickness of this sheet material depends on the type of material and is in general preferably in the range between 0.5 mm and 1.5 mm.

FIG. 7 shows a basic inlay 1 with transverse profiling 2 in the forefoot region, whereas in the waist and heel regions continuous longitudinal profiling 8 is provided, and with through-holes 10 for direct attachment of spikes or for attaching fastening means for spikes.

Figure 8:
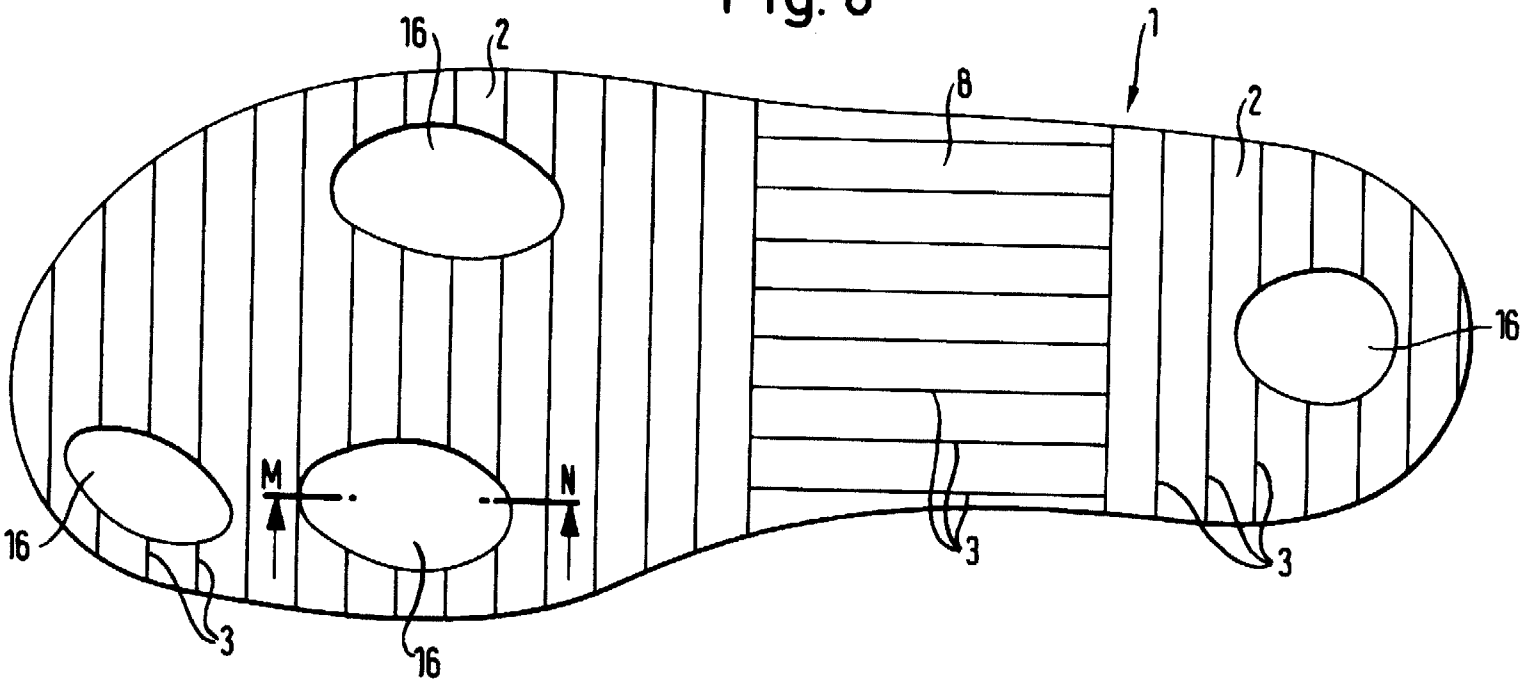
FIG. 8 is a fifth embodiment of a basic inlay according to the invention, which is provided with recesses for improved transmission of the foot pressure to the ground and with continuous longitudinal profiling in the waist region.

FIG. 8 shows a top view of a further embodiment of a basic inlay 1 according to the invention, with transverse profiling 2, which is provided in the forefoot region and in the heel region between longitudinal profiling 8 in the waist region, is interrupted by several recesses 16 facing the ground. The recesses can be of circular shape. The three recesses 16 in the forefoot region are in the region of the large toe and the ball of the foot, whereas rear recess 16 is in the region of the heel.

Figure 9:
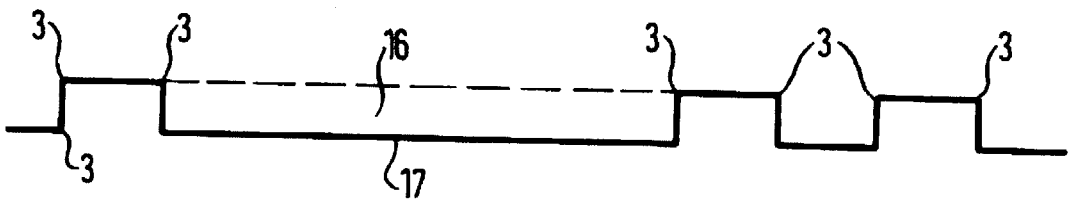
FIG. 9 is a partial cross-section along the line M-N in FIG. 8.

These recesses 16 serve for better transmission of the foot pressure to the floor. As can be seen in FIG. 9, which shows a cross-section along line M-N in FIG. 8 of one of the recesses, base 17 of recess 16 is flat or level and, as a result, at the lowest profiling level closest to the floor.

Figure 10:
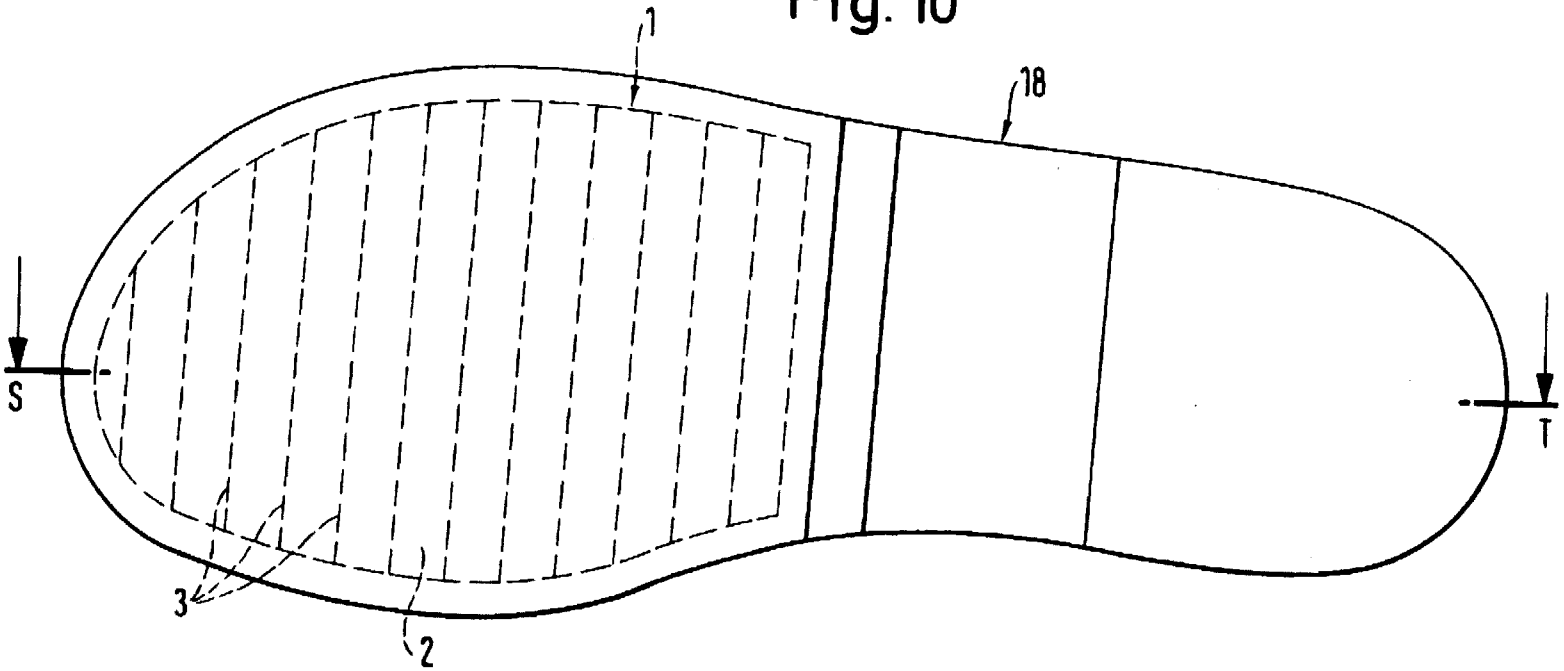
FIG. 10 is a top view of a sole with an inlay indicated by means of a dashed line, which extends only over the area of the forefoot.
Figure 11:
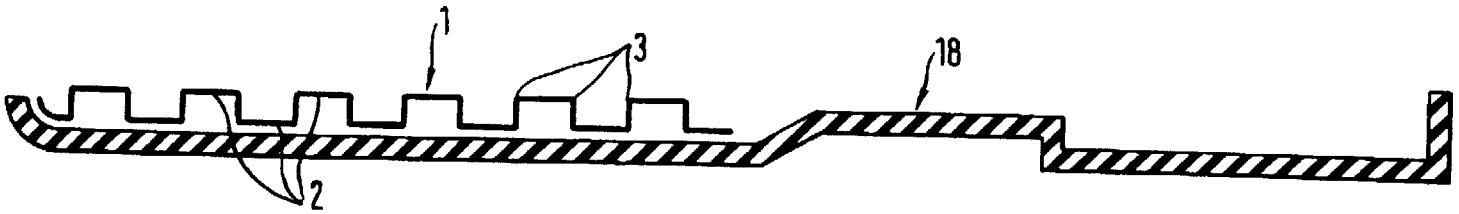
FIG. 11 is a section according to line S-T in FIG. 10, in which the plastic material by means of which the inlay is foamed into the sole, is, for presentational reasons, not shown.

FIG. 10 shows a sole 18 with an inlay 1 indicated by dashed lines, which extends only over the forefoot region and is provided throughout with transverse profiling 2. In FIG. 11, the longitudinal section along line S-T of the sole in FIG. 10 shows only the outsole of sole 18, whereas the plastic material in which inlay 1 is foam-embedded or cork-embedded and which is firmly connected with the outsole, has been omitted for presentational reasons.

Figure 12:
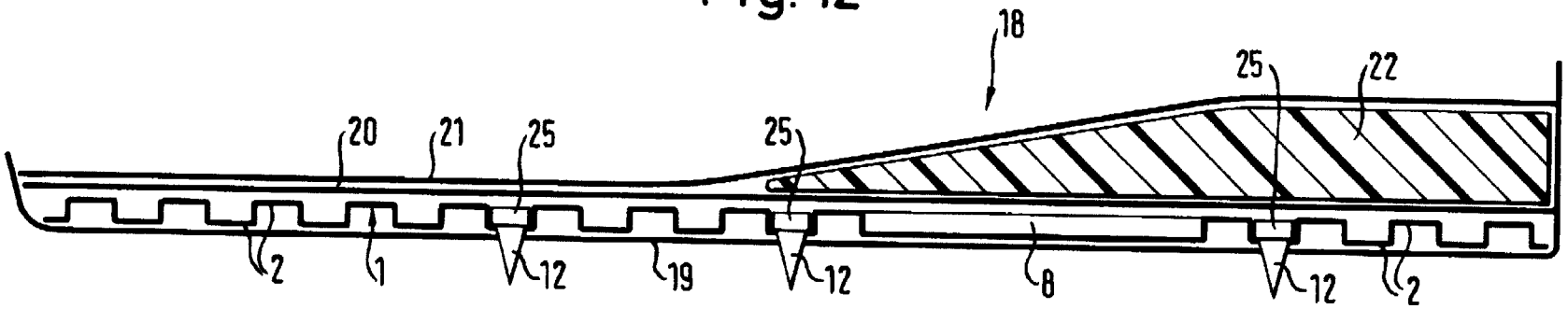
FIG. 12 is a longitudinal section of the sole of a sport shoe according to the invention with flat sole and wedge-heel inlay.
Figure 13:
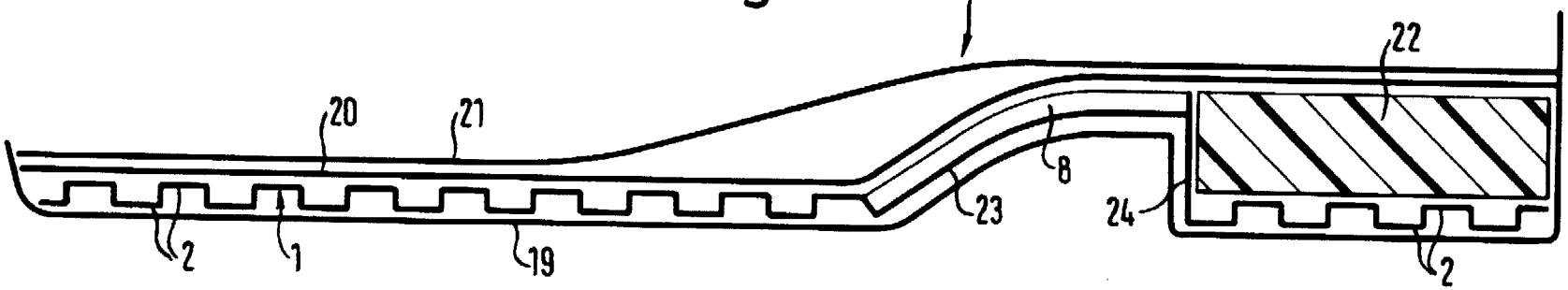
FIG. 13 is a longitudinal section in accordance with FIG. 12 of a different embodiment of a sport shoe, according to the invention, with heel.

FIGS. 12 and 13 show in diagrammatic manner how an inlay 1 is preferably integrated into the overall structure of a sole, i.e. between outsole 19, on the one hand, and the interior sole 20 as well as orthopedic sock 21, on the other hand, whereby heel component 22 may, with a flat sole 18 as shown in FIG. 12, be a wedge insert.

Both inlay 1 of sole 18 according to FIG. 12 and sole 18 according to FIG. 13 are provided with continuous transverse profiling in the forefoot region and in the heel region, whereas in the waist region longitudinal profiling 8 is provided. With a heeled shoe having the sole 18 according to FIG. 13, this longitudinal profiling is designed in the form of a rising arch, as shown at 23, and it passes via a steep downward wedge 24 of inlay 1 at the start of the heel into transverse profiling 2 of the heel region.

With the sole according to FIG. 12 spikes 12 are pushed through corresponding through-holes of inlay 1 into transverse profiling 2 of the forefoot region and the heel region, the base parts 25 thereof, which are lateral supported against the vertical flanks of transverse profiling 2, being, for instance, welded to inlay 1 or attached in some other manner to said inlay. To make the soles provided with an inlay according to the invention use may be made of any conventional material, whereby other conventional inlays, such as the heel wedge with the wedged shoe according to FIG. 12 can be foam-embedded into the sole, together with inlay 1.

Figure 14:
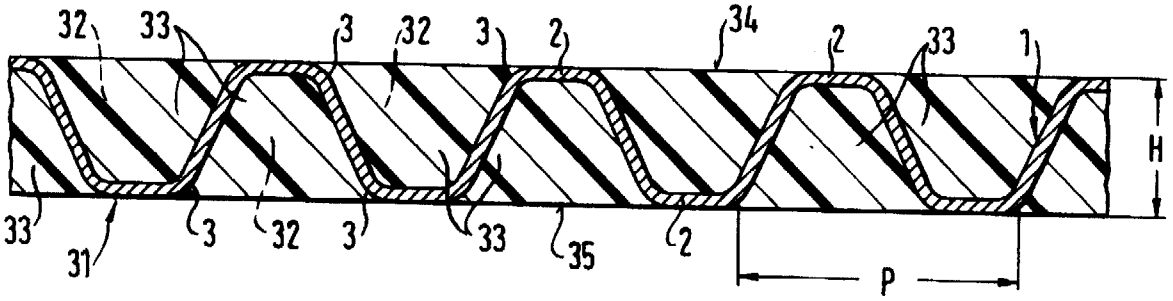
FIG. 14 is an enlarged partial longitudinal section of a first embodiment of an insole formed of an inlay by filling the profiling cavities and/or intermediate spaces with a filler material so as to form upper and lower, plane surfaces.
Figure 15:
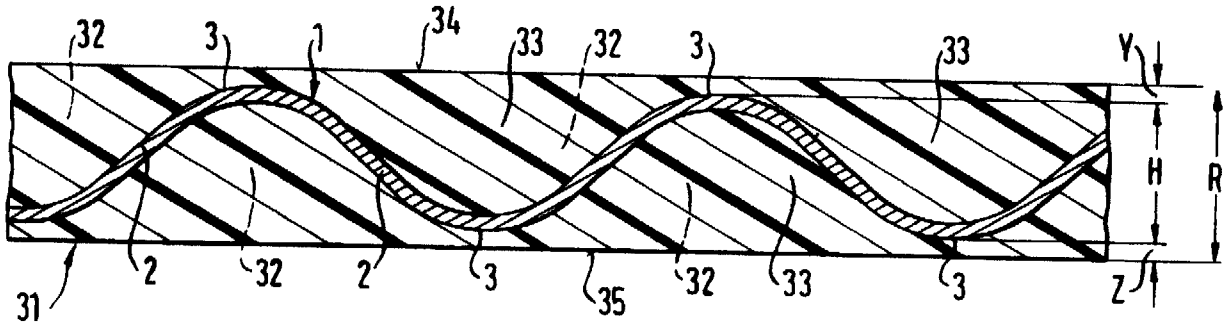
FIG. 15 is an enlarged partial longitudinal section of another embodiment of an insole formed by an inlay with filler composition, the filler composition covering the profiling on both sides.
Figure 16:
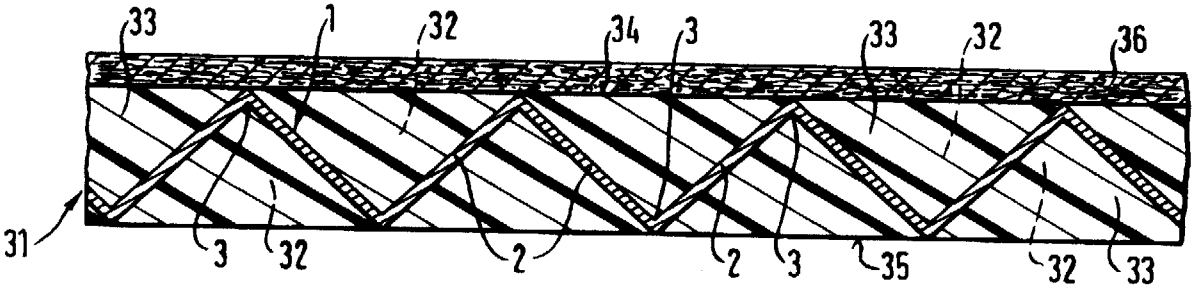
FIG. 16 is an enlarged partial longitudinal section of still another embodiment of an insole consisting of an inlay made plane on both sides by means of a filler composition and a thin inlaid sole (inlay) bonded on one side or lying loosely.

FIGS. 14, 15 and 16 show much enlarged partial longitudinal sections, not necessarily to scale, of three embodiments of an insole 31 comprising an inlay 1 with transverse profiling 2 and a filler composition 33 (shown in hatching) filling up the profiling cavities and/or intermediate spaces 32. This filler composition 33 fills up the profiling cavities and/or intermediate spaces 32 in such a way that the upper surface 34 and the lower surface 35 of the insole are level. This filler material can also cover the edges of the inlay so that the inlay is sheathed by the filler material. It is also possible to provide the filler material only over a part of the upper and/or lower side of the inlay.

The inlay 1 and the filler composition 33 are preferably connected with each other in firmly adhesive manner to give a component, e.g. by bonding and vulcanizing, when consisting of metal the inlay being preferably provided with a primary coat for improving adhesion. The filler composition may be or contain plastic and/or cork and/or felt and/or other filler material.

While in FIG. 14 the thickness of the insole 31 equals the height H of the inlay 1, in the insole 31 according to FIG. 15 the thickness R of the filler composition 33 is greater than the height H of the inlay 1, so that on both sides of the insole thin layers Y and Z of filler composition cover the inlay 1. Layer Y may also only be provided on one side, preferably on the side facing the foot, in particular to improve the comfort for the foot.

In the embodiment according to FIG. 16 the comfort for the foot is even much improved by bonding or loosely applying a thin inlaid sole 36 to the upper side 34 of the composite article formed of the inlay 1 and the filler composition 33.

The inlay 1 shown in FIG. 14 having cross-sectionally rounded trapezoidal transverse profiling 2 may be for example the basic inlay shown in FIG. 1. In this Figure the inlay consists for example of spring steel sheet having a primary coating and a material thickness of preferably 0.2 mm and a profile period P of 5 mm and a height H of 2.0 mm and is levelled on both sides by a filler composition made of soft elastic plastic or of cork.

The inlay 1 shown in FIG. 15 having groove-like transverse profiling may be for example the basic inlay shown in FIG. 2. The inlay 1 shown in FIG. 16 having zigzag-like transverse profiling may be for example the basic inlay shown in FIG. 3 but perferably without the spike holes 10 and without the plane regions 13 of FIG. 3. Basically the insole 31 may be made of any inlay according to the invention, whereby in the case of the inlays according to FIGS. 8 and 9 the recesses 16 may also be filled with the filler composition 33 which may also have shock-absorbing properties.

It is self-evident that the filler composition has an hardness considerably reduced as compared to that of the inlay material, e.g. is soft elastic and possibly also shock-absorbing material, so that the properties of the inlay according to the invention are highly effective in spite of the filler composition. The same also applies to the plastic or cork material by which an inlay according to the invention can be surrounded by molding or pressing or other forming processes.

Advantageously, an inlay according to the invention can completely or partly be sheathed with cork or synthetic resin, particularly soft synthetic resin (e.g. FIG. 15).

Figure 17:
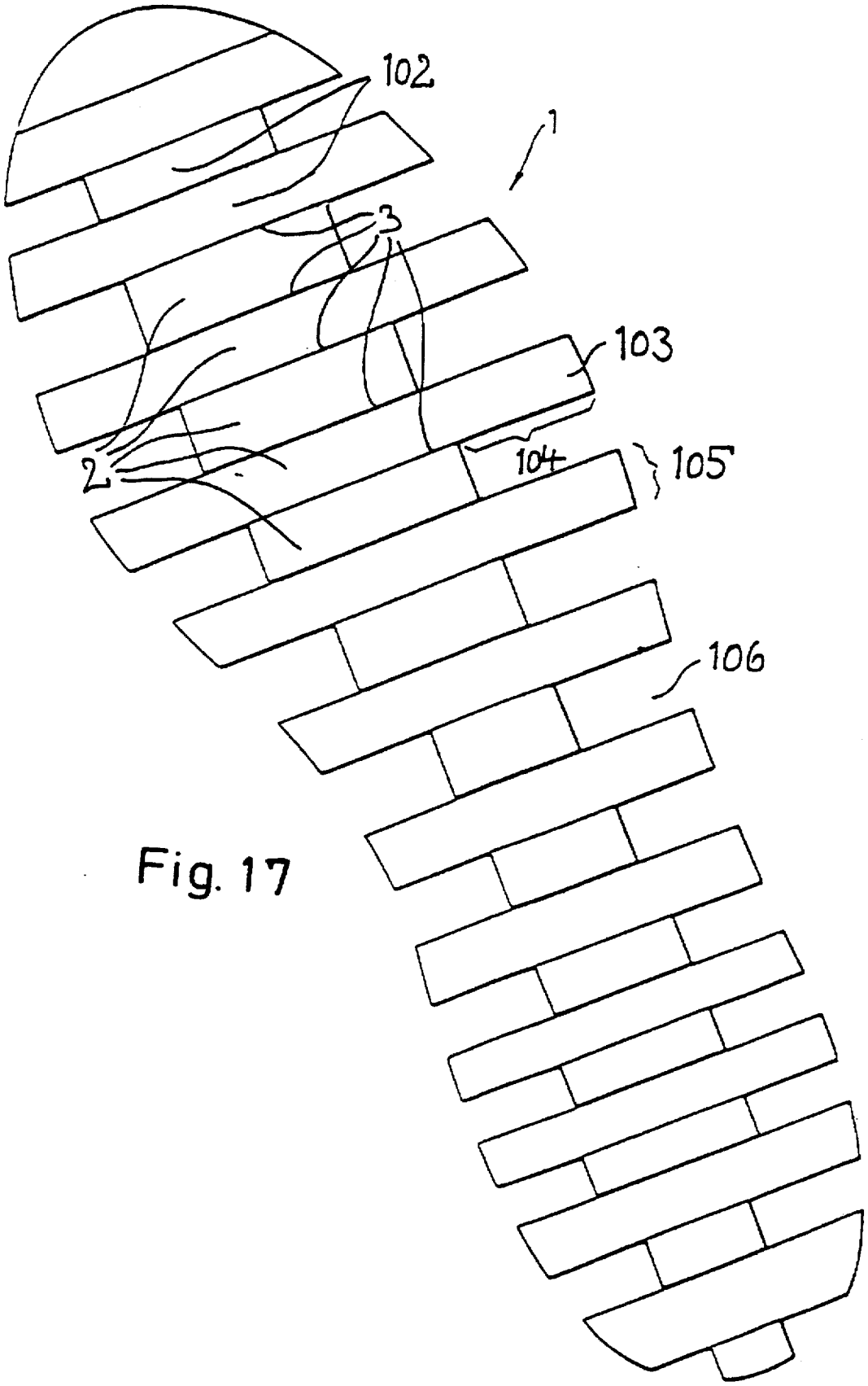
FIG. 17 is a plan view of a further development of an inlay according to the invention, showing the flat parallel tongues.

FIG. 17 shows an inlay 1 which consists of a central core 102, which runs in a longitudinal direction of the sole, and which has a meandering, parallel, transverse profiling. Flat parallel tongues 103 are provided on this central core 102 or longitudinal element; these extend to the outer edge of the foot and are no longer included in the profiling structure, but are flat. The parallel tongues 103 may have different lengths 104 and different widths 105 to correspond to different local damping behavior, as required. The flat parallel tongues 103 are formed by providing recesses 106 in the transverse profiling 2 of the inlay 1 and for this form of inlay are distributed on both the inner side (left in FIG. 17) and the outer side (right in FIG. 17) over the total length of the inlay (the outer and inner sides of an inlay correspond to the outer and inner sides of the foot).

Figure 18:
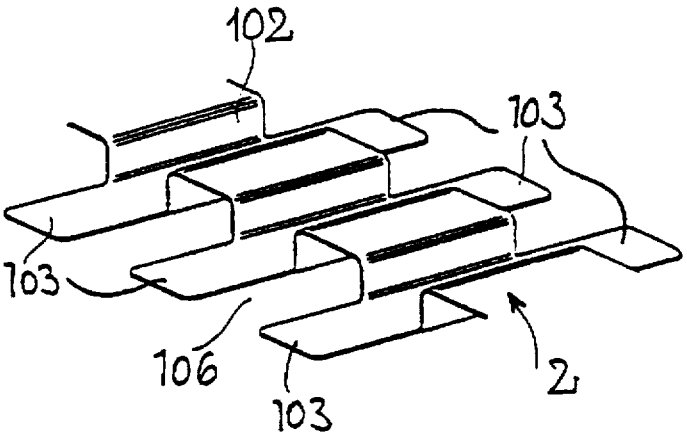
FIG. 18 is a detailed perspective view of the transverse profiling and the flat parallel tongues.

FIG. 18 shows an oblique view of part of the inlay 1 of FIG. 17, for which the material preferably consists of spring steel and the tongues 103 are flat.

The inlay 1 in FIG. 17 (and also the other inlays), which is also shown in FIG. 18, is preferably incorporated within a sole of a shoe or is covered with foam within a sole of a shoe. The intermediate spaces created by the profiling 2 are preferably filled with foam or cork or provided with another material. The flat parallel tongues 103 can then bend upwards on loading and take with them the attached material of the sole and the upper on the outer side of the foot. This bending process facilitates better contact between the inner or outer side of the foot and the ground for a given loading. The twisting and distortion behavior required for different types of sport can be produced by using arrangements of the flat parallel tongues 103 which differ in terms of their length and/or width.

Figure 19:
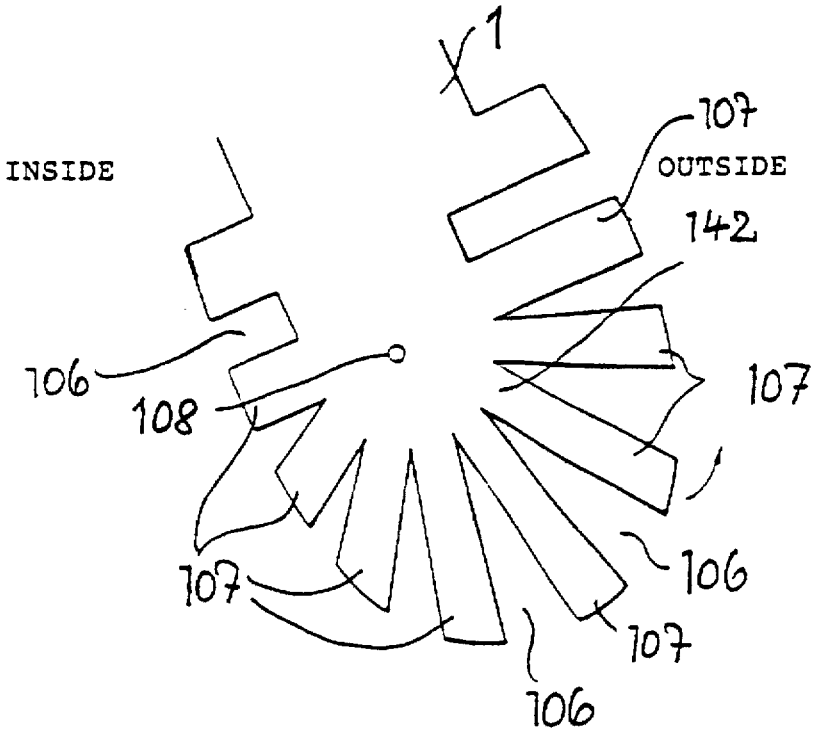
FIG. 19 shows an arrangement according to a further development of the invention of the heel region of an inlay otherwise provided with a transverse profiling, which heel region has flat radial tongues.

FIG. 19 shows bendable lath-shaped radial tongues 107 (inlay elements) which remain in the heel region of the inlay 1, which have spaces between them formed by removing material between them or by recesses 106, and which are concentrated on the heel point 108 (the heel point 108 is denoted by J in the pattern of the insole).

Figure 20:
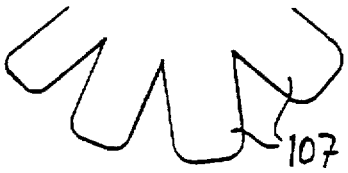
FIG. 20 shows an arrangement of the flat radial tongues of an inlay according to a further development of the invention, which flat radial tongues remain in the heel region after cutting out recesses.

FIG. 20 shows another arrangement of the lath-shaped radial tongues 107, with rounded corners. These laths are substantially rectangular; FIG. 20 shows them rounded at the end.

Figure 21:
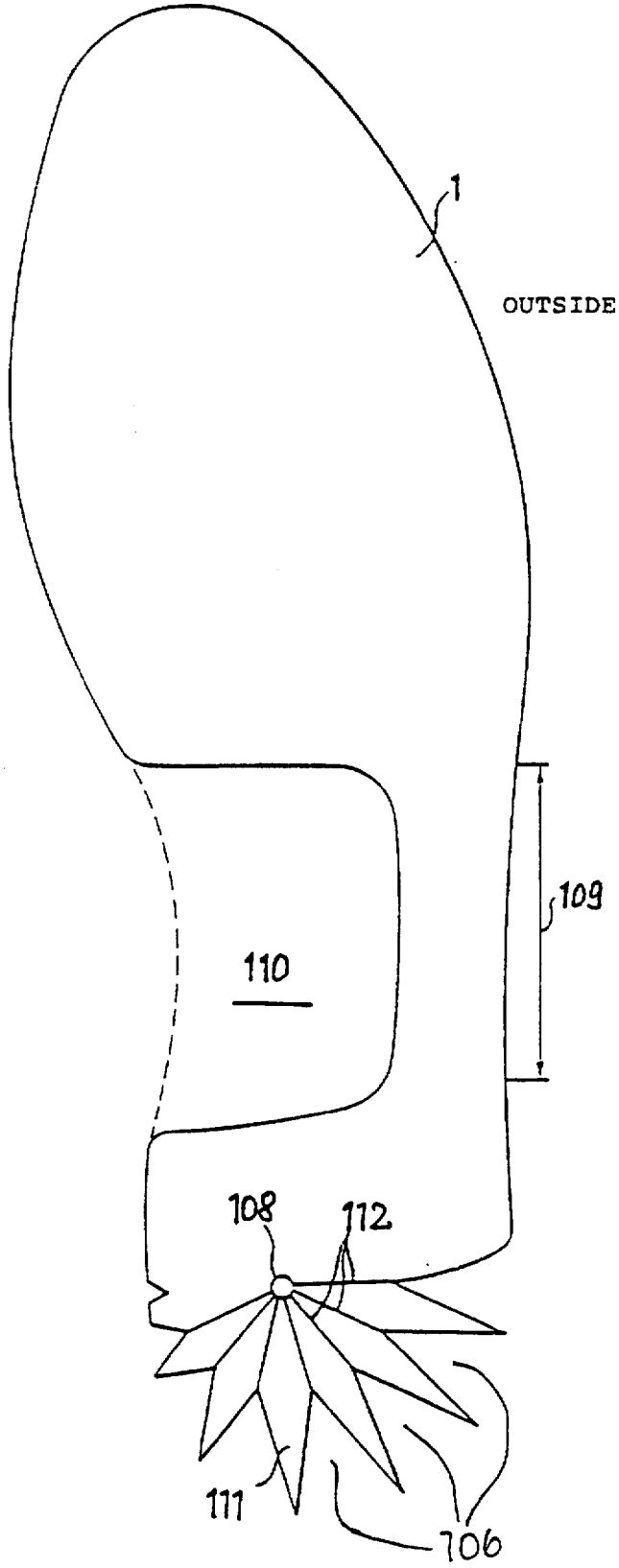
FIG. 21 shows star-shaped radial tongues of an inlay in the heel region and a recess in the region of the foot's joint part of the inlay.

FIG. 21 shows star-shaped radial tongues 111, which have their points facing outwards and are grouped in the form of a star around the heel point 108. From the inner ends of cut-out portions 106 between the radial tongues 111, radial elevations 112 run between the radial tongues 111 in the region of the heel, and are concentrated on the heel point 108. FIG. 21 also shows a recess 110 in the region of the joint part 109 of the foot; this size of recess was cut out from the inlay 1 to allow torsion between forefoot and rearfoot, particularly an inlay made of spring steel. No further details as regards the transverse profiling are shown in FIG. 21.

Figure 22:
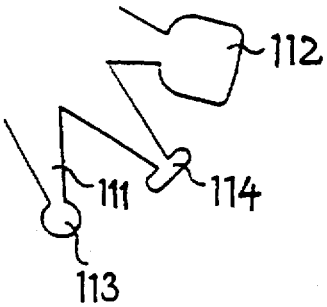
FIG. 22 shows flat radial tongues of an inlay cut out in the heel region with sections of different widths and shapes at their free ends.

FIG. 22 shows regions of increased width which are e.g. plate-shaped 112, club-shaped 113 and extended 114; these produce a widening of the surface at the end of the radial tongues 111.

Figure 23:
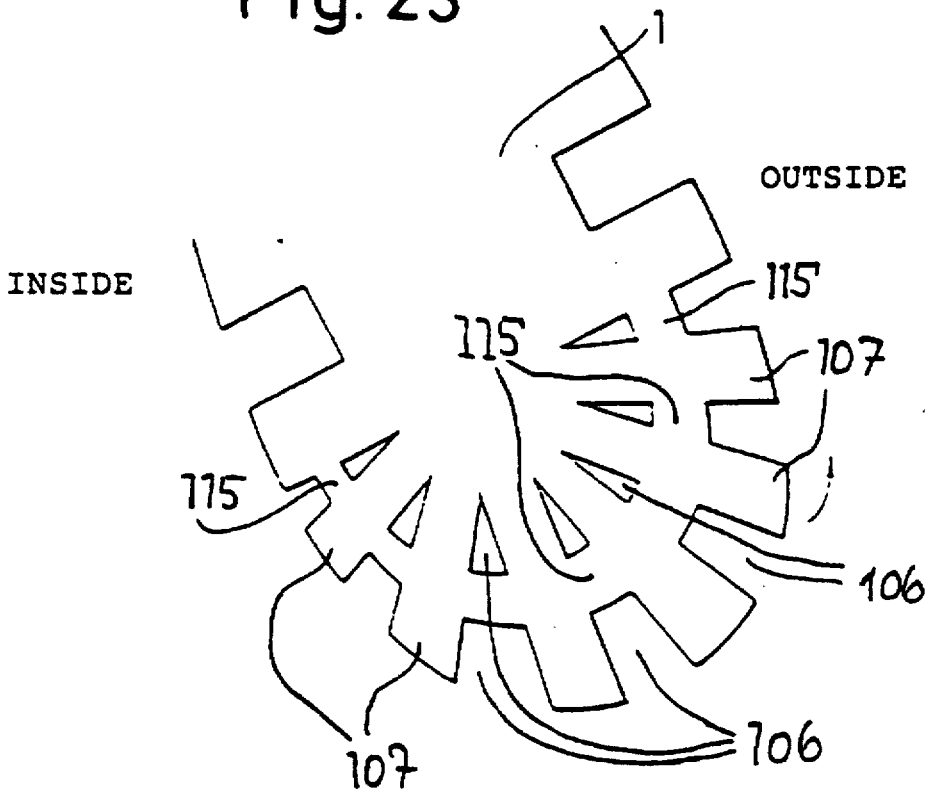
FIG. 23 shows an arrangement of flat radial tongues according to the invention in the heel region, with webs between the radial tongues of the inlay which have been cut out.

FIG. 23 again shows the rear portion of an inlay 1, wherein webs 115 each form a bridge between the remaining lath-shaped flat radial tongues 107; these bridges influence or control the damping behavior.

In FIG. 19, the remaining blade-shaped or lath-shaped radial tongues 107 are arranged so that their bases 142 are in the region of the heel point 108 of J which is known from the section or scheme of the insole. The bases 142 of the flat radial tongues 107 are arranged radially around the heel point 108, and recesses 106 exist between the radial tongues 107. These radial tongues 107 can distort when a loading is applied to the outer side of the foot and bend around their base 142. The radial tongues 107 are given a fixed covering of foamed material, to protect the wearer from injury. The flat radial tongues 111 shown in FIG. 22 are provided with wider regions in the form of small plates, clubs, or extended sections at the ends of the star-shaped radial tongues, to prevent the foamed material from breaking up too quickly. The damping effect of the radial tongues can be increased by the intermediate webs 115 shown in FIG. 23.

Figure 24:
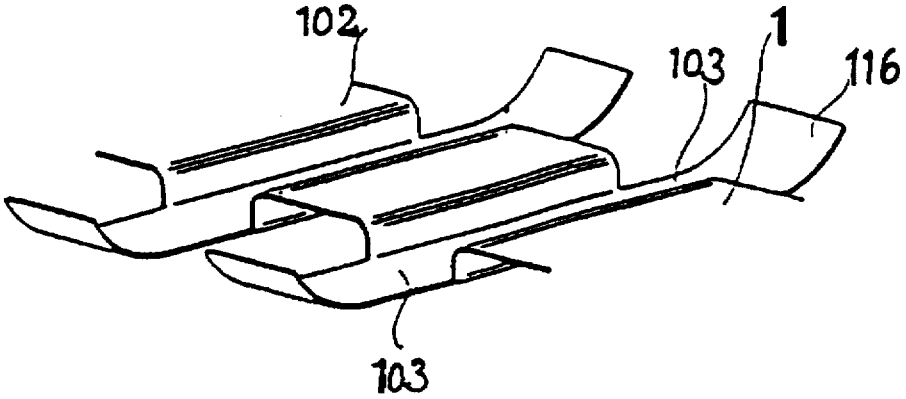
FIG. 24 shows flat parallel tongues which are pre-bent upwards towards the wearer's foot.

FIG. 24 shows a section of the inlay 1 of FIG. 17, wherein the meander profiling arrangement of the main part 102 of the inlay i can be recognized. The flat parallel tongues or plates 103 are pre-bent upwards in the region of their ends 116.

FIG. 25 likewise shows a partial section of the inlay 1 with the core piece 102. The flat parallel tongues 103 are bent downwards at their end regions 117 and form a flute which is open downwards, wherein a trampoline effect is exerted on axial loading. The choice of whether the falt parallel tongues 103 are located on the upper or lower part of the meander profiling is different for each specific type of shoe.

FIG. 26*a* shows a two-piece inlay, which comprises a part 118 at the front of the foot and a part 119 at the rear of the foot. These two parts are independent of each other and are attached to each other via a torsion element 120 at riveted plates 121. No further detail of the arrangement is shown.

FIG. 26*b* shows the course of the line 122 of the points of application of force, and also the directions of the transverse profiling 2 (see the profiling edges 3) which are approximately at right angles to the line 122 of the points of application of force.

Figure 27:
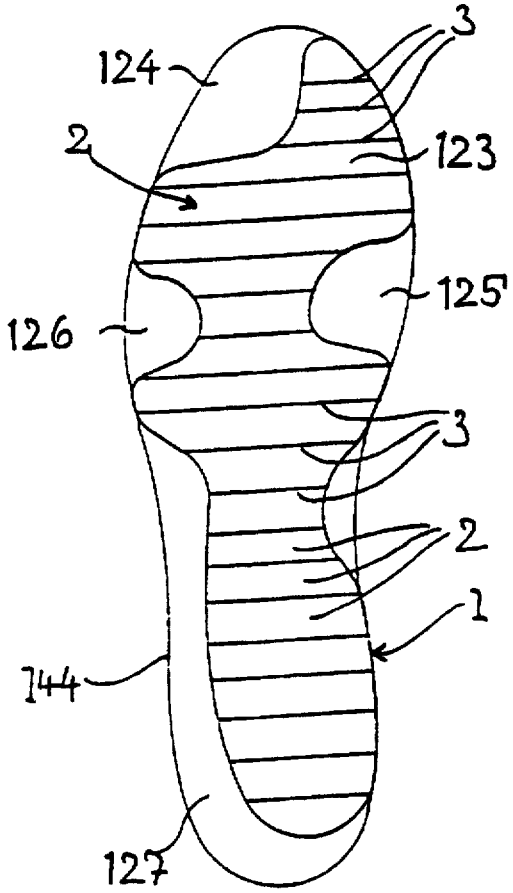
FIG. 27 shows an embodiment of a sculpted inlay according to a further development of the invention.

FIG. 27 shows a sculpted inlay 123, which is recessed in the region 124 of the third to fifth toes, in the region 125 of the ball of the big toe, in the region 126 of the ball of the little toe, and in the region 127 of the heel. The outline drawn round the inlay 1 corresponds to the complete sole or insole 144, which is to be covered with foamed material or sheathed partly or completely with cork.

Figure 28:
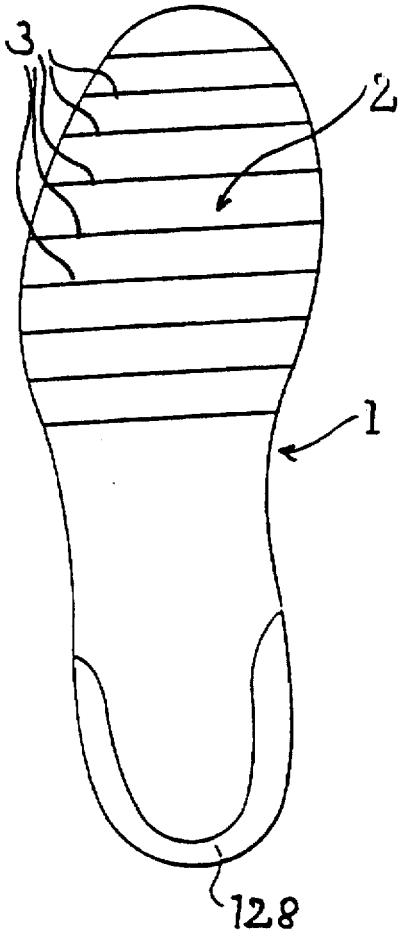
FIG. 28 is a plan view of an inlay with heel-piece.
Figure 29:
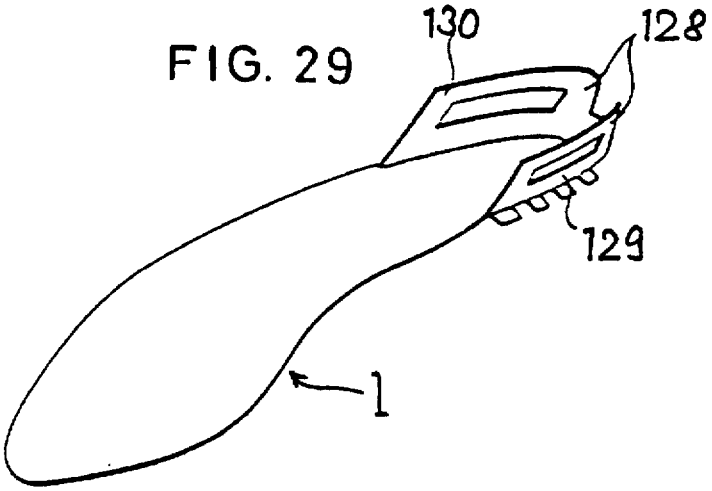
FIG. 29 is a perspective view of an inlay with heelpiece.

FIG. 28 shows a heel-piece 128, which is riveted to the inlay 1. No other details of the inlay 1 are shown. FIG. 29 shows a heel-piece 128 which is riveted onto the inlay and which consists of an inner part 129 and an outer part 130.

Figure 30:
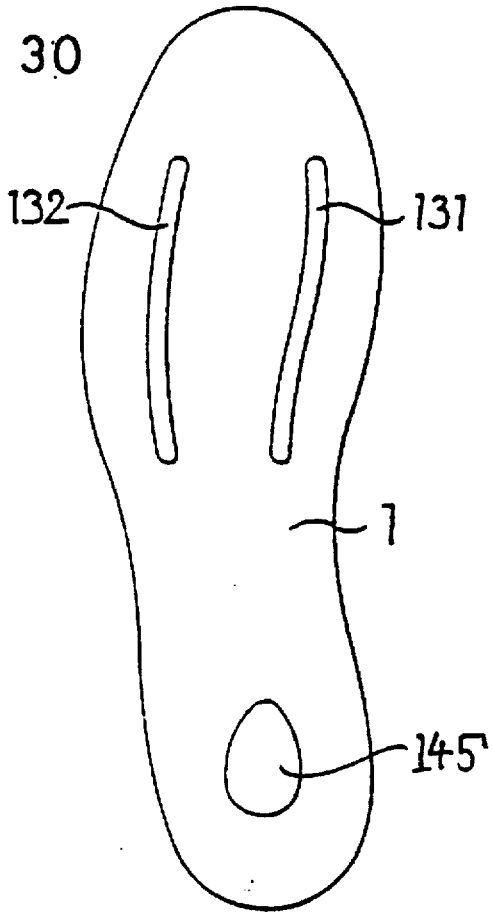
FIG. 30 is a plan view of a further development of an inlay with longitudinal slits and a recess.
Figure 30:
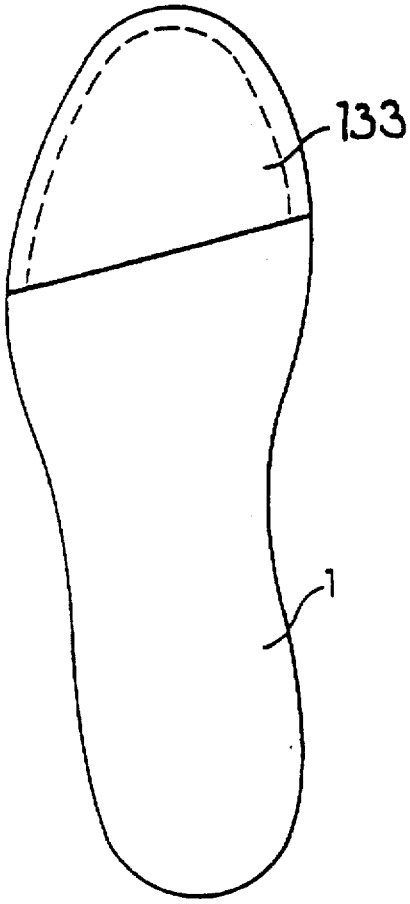

FIG. 30 shows an inlay i without fine details, with an inner 131 and outer 132 longitudinal slit in the region of the front and the middle of the foot and with a cut-out 145 in the middle of the heel.

Figure 31:
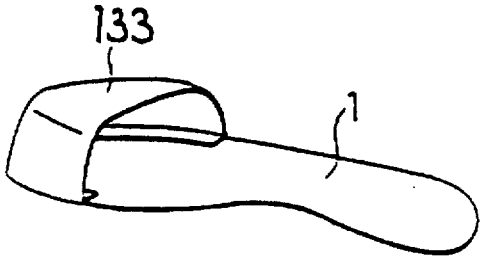
FIG. 31 shows an inlay with a cap at the front of the foot.

FIG. 31 comprises a plan view and an oblique view of a toe-cap 133 which is riveted to the inlay 1; no further details are shown of the inlay 1.

FIG. 32 is an oblique view of the rear part of a spring steel inlay 1, the profiling of which is not shown in the drawing. A leaf spring 136 is riveted to the inlay 1 in the region 134, and is open on the inner side in this example. FIG. 33*a* is a section along the line A–A' of FIG. 32, showing the state with no loading. A damping element 135, i.e. an elastic material piece, is located between the inlay 1 and the leaf spring 136. In the loaded state shown in FIG. 33*b*, the applied pressure causes the inlay i and the leaf spring 136 to approach each other and compress the damping element 135.

FIG. 34*a* shows a leaf spring 137 which is pre-bent to produce an initial stress or bias. This is riveted to the inlay 1 in region 134. The prestressed leaf spring 137 touches the inlay 1 at point 138. FIG. 34*b* shows the behavior of both elements on loading. The leaf spring 137, which is preferably made of steel or other resilient material, rests on the inlay 1 in contact over practically the whole surface area of the leaf spring, and damps the load which arises.

FIG. 35 shows the region at the rear of the foot of an inlay 1 which is made of spring steel and has a meander profiling. Here a steel spring element 139 projects into the internal cavity of the shoe and is fixed to the outside with a rivet at region 134 on the inlay 1. A damping element 135 can be accommodated in the intermediate space 140.

Before considering FIGS. 36 to 40 and 42 in more detail, it should be mentioned that in these Figures the thin white lines and darkened intermediate portions represent the transverse profiling 2, whilst the thick white lines or regions represent slits or recesses; these can be formed, for example, by stamping them out.

Figure 36:
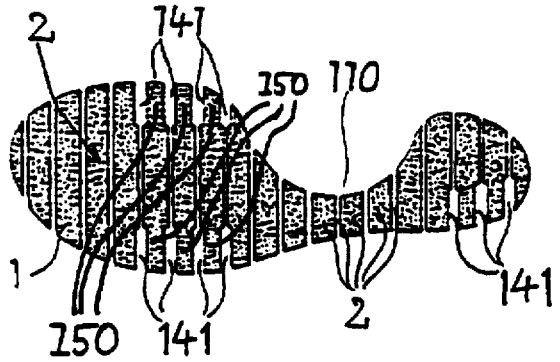
FIG. 36 shows a further development of an inlay provided at its edge with slits parallel to the direction of the transverse profiling and with a recess in the joint part of the foot.
Figure 37:
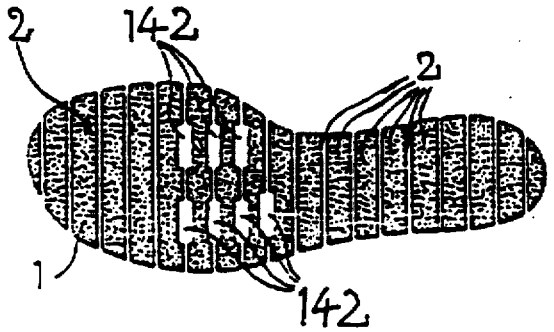
FIG. 37 shows a further development of an inlay provided with slits parallel to the direction of the transverse profiling in its central region.

The inlay 1 shown in FIG. 36 is provided with slits 141, which are parallel to the direction of the transverse profiling 2, and which extend from the edges of the inlay 1 at the inner and outer side of the foot in the region of the forefoot, and from the edge of the inlay 1 at the outer side of the foot in the region of the heel, over a predetermined length of the inlay 1 in each case in the direction of the longitudinal axis (not shown). Moreover, the inlay 1 shown in FIG. 36 has a recess 110 in the region of the ankle joint part. In contrast to this, the inlay 1 shown in FIG. 37 is provided with slits 142 in the interior region of the inlay; these likewise run parallel to the direction of the profiling but do not extend to the edges, as do the slits shown in FIG. 36. Examples of slits 142 of this type, which do not extend to the edge of the inlay 1, are shown in perspective in FIG. 43, wherein the profiling is constructed as an undulating profile of the inlay.

Figure 41:
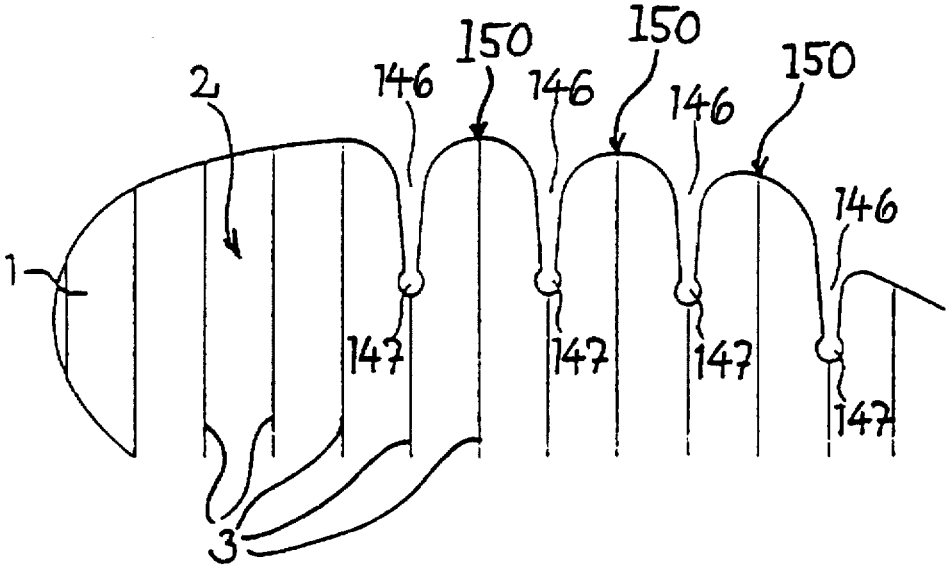
FIG. 41 shows an arrangement of beaded channels in an inlay of the invention.
Figure 43:
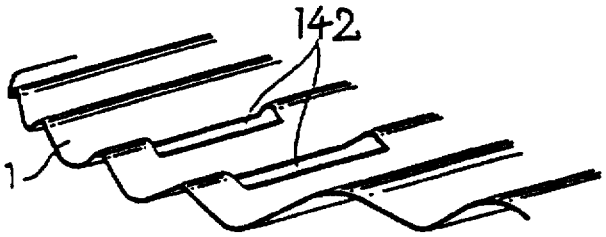
FIG. 43 is a perspective view of slits in the transverse profiling of an inlay according to a still other further development of the invention.

The slits 141 in FIG. 36 and the slits 142 in FIGS. 37 and 43 as well as the channels (slits) 146 in FIG. 41 are provided for allowing a better rolling-up motion in desired areas of the inlay. Thus the portions of the inlay extending between such slits or channels, e.g. the tongues 150 in FIGS. 36 and 41, must not be flat (in contrast to the flat tongues 103 of e.g. FIG. 17).

Figure 38:
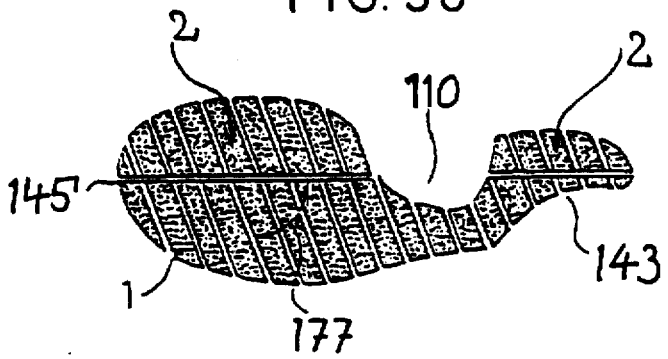
FIG. 38 shows a sculpted inlay, which still partially retains the outline of the corresponding insole.
Figure 44:
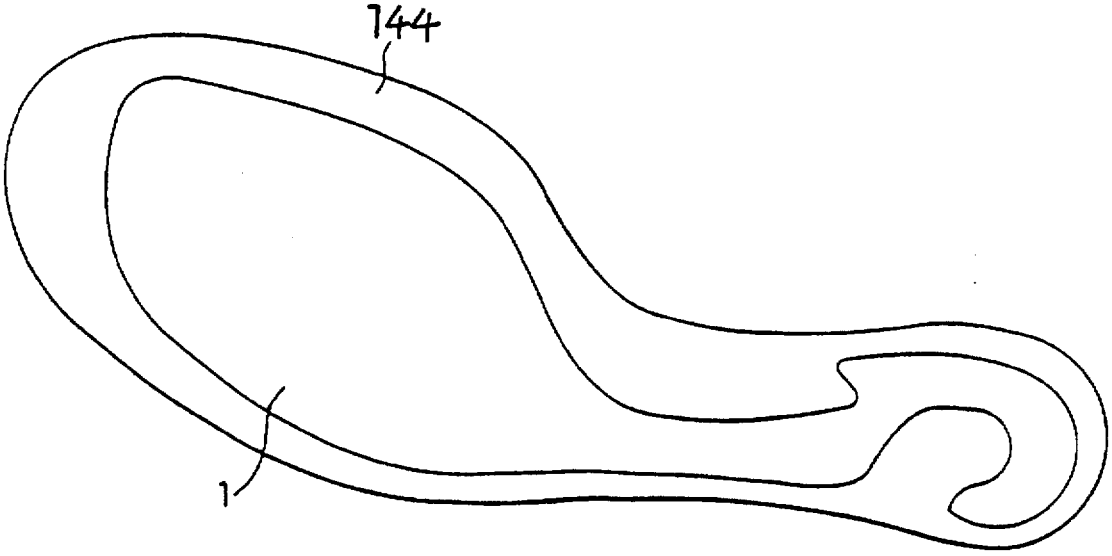
FIG. 44 shows the outline of a heavily sculpted inlay according to yet another further development of the invention, which is inside the outline of the corresponding insole.

FIGS. 38 and 44 each show a sculpted inlay; the transverse profiling 2 is not shown in FIG. 44. The inlay 1 shown in FIG. 38 has been subjected to a relatively small amount of sculpting; two recesses are provided, namely a recess 110 in the region of the ankle joint part and a recess 143 in the heel region at the outer side of the foot. However, the major part of the inlay 1 which remains has the outline of the corresponding insole. In contrast, FIG. 44 shows the results of a sculpting process of major proportions, for which the outline of the inlay 1 is smaller all round than the outline of the corresponding insole 144.

Figure 39:
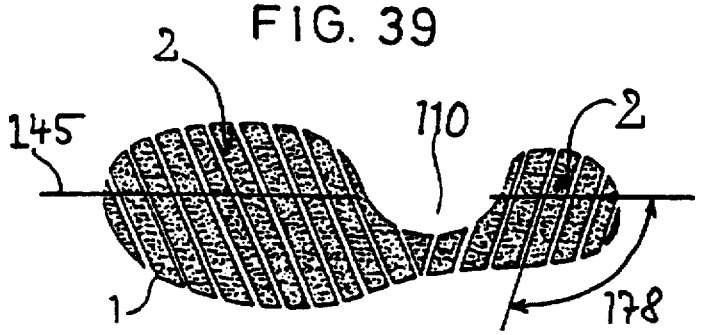
FIG. 39 shows a further development of an inlay which has a transverse profiling running obliquely outwards and backwards (77° to the longitudinal axis) in the front part and a transverse profiling running obliquely outwards and forwards (103° to the longitudinal axis) in the rear part, and which has a wide recess in the joint part of the foot extending from the inner edge to beyond the center line, with each of said transverse profilings extending up to the middle of this recess.
Figure 42:
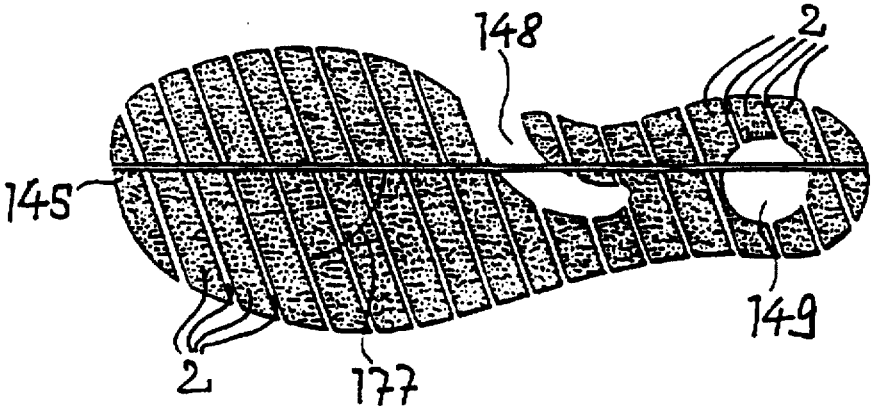
FIG. 42 shows recesses for receiving damping elements in an inlay which has a transverse profiling with its direction extending at an angle of 77° to the longitudinal axis of the inlay or the sole.

Whereas the inlay 1 shown in FIGS. 36, 37, 40 and 41 has a transverse profiling 2 which runs at right angles to the longitudinal direction of the inlay, the inlay 1 shown in FIGS. 38 and 42 has a transverse profiling 2 which runs from the outside edge of the inlay at a rearwardly open acute angle 177 to the longitudinal axis 145. The angle 177 shown is 77°, where this angle is defined as the angle between the direction of the profiling which runs from the axis 145 to the outer side of the foot and the branch of the longitudinal axis which runs from the point of angle measurement towards the heel, so that an acute angle 177 denotes a transverse profiling which runs backwards in the direction of the outer side of the foot. The aforementioned acute angle lies generally in the range from 70° to 86°, and more preferably in the range from between 74° to 78°. FIG. 39 shows a transverse profiling 2 which in the front region of the inlay 1 runs at an acute angle, shown here as 77° (as in FIGS. 38 and 42), to the longitudinal direction of the inlay, whilst in the rear part it is inclined at a rearwardly open obtuse angle 178, shown here as 103°, to the longitudinal axis 145 of the inlay 1 or insole, and wherein the front part having the angle 177 extends forwards from the recess 110 provided in the region of the ankle joint, and the rear part having the angle 178 extends backwards from this recess 110. The aforementioned obtuse angle 178 generally lies in the range from 95° to 120°, and more preferably in the range from 100° to 115°.

Figure 40:
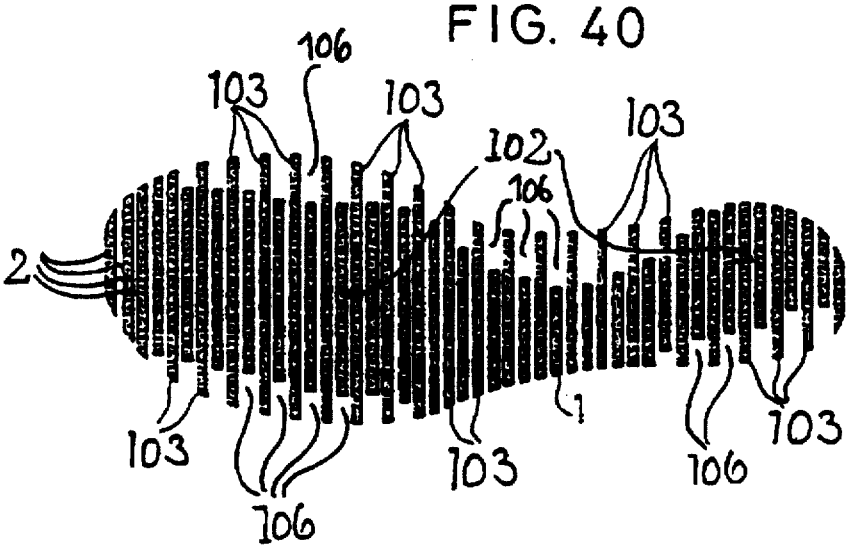
FIG. 40 is a plan view of an inlay according to another further development of the invention, wherein the thin white strips and the darkened strips represent the transverse profiling, whilst the broad white regions are recesses formed in different lengths and numbers between the flat parallel tongues.

FIG. 40 shows an inlay 1 which is provided with a multiplicity of tongues 103. These tongues 103 are of different lengths and there are different numbers of them that are provided in the regions of the inlay 1 on the inner side and the outer side of the foot. Depending on the purpose of the tongues 103, these tongues 103 can be flat as shown e.g. in FIG. 17 or can have a non-flat (e.g. curved) cross section as the tongues 150 of FIGS. 36 and 41.

FIG. 41 shows beaded channels 146 which run parallel to the direction of the profiling 2 and end in a wider, circular region 147 within the inlay 1.

FIG. 42 shows recesses 148 and 149, which are provided to receive damping elements in the region of the ankle joint and in the heel region of the inlay 1.

Figure 45:
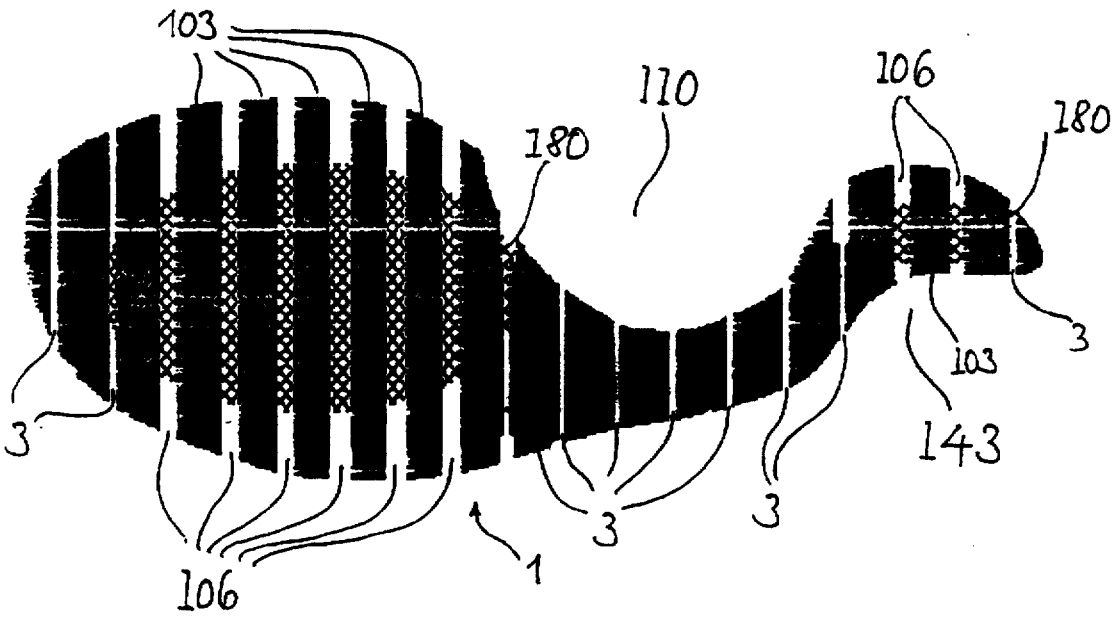
FIG. 45 finally shows a further development of a sculpted inlay according to the invention wherein some parallel tongues extend through the whole width of the inlay and are connected with each other and the remainder of the inlay by a sheet-like or net-like flexible element.

Finally, FIG. 45 shows a further development of a sculpted inlay 1 of the type depicted in FIG. 38 and provided with recesses 106 and parallel tongues 103 of the general types shown e.g. in FIGS. 17, 18, 25 and 40. However, in contrast to the embodiments of FIGS. 17, 18, 25 and 40 the recesses 106 extend over the full width of the inlay so that the parallel tongues are not connected by a transversely profiled central core 102. Instead the separated parallel tongues 103, preferably flat tongues, are adhesively connected by a piece 180 of fabric-like, net-like or sheet-like flexible material which is e.g. of rubber or caoutchouc, canvas, flexible plastic material or the like. Such inlay needs not necessarily have the recesses. 110 and/or 143 but can also be an unsculpted inlay. By this construction there is obtained a maximum of flexibility in the region(s) where the core 102 is omitted and the parallel tongues extend over the whole width of the inlay. At the same time the resistance against pressure regions from the ground (small stones etc.) is maintained.

Unless otherwise stated, the transverse profiling, which is not shown in all the drawings for reasons of simplifying the representation, extends over the whole inlay and can have a cross-section in the form of grooves, corrugations, ribs, channels, waves, flutes or beads, preferably in the shape of meanders, trapezoids, zig-zags or shapes similar to meanders.

Finally, unless otherwise stated, the inlay according to the invention is a one-piece inlay which is preferably of uniform thickness, in which the profiling is incorporated by deformation, for example by stamping, or by the original forming process, for example injection molding. The recesses, slits and the like can likewise be provided either by deformation, for example, stamping out, or by the original forming process, for example a relieving process.

We claim:

1. An inlay for a shoe, comprising a plate formed of a hard, resilient plate material, said plate including forefoot and heel regions and forming inside and outside edges each extending along the forefoot and heel regions; said plate formed with profiling disposed within said forefoot region and extending transversely relative to a longitudinal direction of the inlay; said profiling having a cross-section consisting of periodically repeating profile elements, each profile element comprising a ridge and a recess, each profile element extending non-perpendicularly relative to said longitudinal direction such that said profile elements extend from said outside edge at a rearwardly open acute angle with respect to the longitudinal direction, said acute angle being in the range of 70° to 86°.

2. The inlay according to claim 1, wherein said acute angle is in the range of 74° to 78°.

3. The inlay according to claim 1, wherein said profiling is situated in said heel region.

4. The inlay according to claim 1, further including additional profiling disposed within said heel region, said additional profiling extending from said outside edge at a rearwardly open obtuse angle in the range of 95° to 120° with respect to the longitudinal direction.

5. The inlay according to claim 4, wherein said obtuse angle is in the range of 100° to 115°.

6. The inlay according to claim 1, wherein the inlay constitutes at least a portion of an insole.

7. The inlay according to claim 1, wherein the inlay constitutes at least a portion of an outer sole.

8. The inlay according to claim 1, wherein said ridge has the same width as said recess.

9. The inlay according to claim 1, wherein said periodically repeating cross-sectional profile elements have a width which is in the range from 3 mm to 20 mm.

10. The inlay according to claim 1, wherein said transverse profiling has a cross-section selected from the group consisting of grooved, fluted, ribbed, channelled, undulated, meandering, furrowed, bead-type, corrugation-like, trapezoidal and zig-zag-shaped cross-sections.

11. The inlay according to claim 1, wherein said hard, resilient plate material is selected from the group consisting of metal, plastic, steel, spring steel.

12. The inlay according to claim 1, wherein said hard resilient plate material has a thickness between 0.1 mm and 1.5 mm.

13. The inlay according to claim 1, wherein said inlay extends throughout substantially the entire forefoot region of said insole.

14. The inlay according to claim 1, wherein said inlay extends over substantially the entire area of the sole of said shoe.

15. The inlay according to claim 1, wherein said inlay is embedded in cork or plastic and includes through-holes for conducting the cork or plastic material during the embedding.

16. The inlay according to claim 1, wherein said inlay is embedded in cork.

17. An insole according to claim 1, wherein said inlay is embedded in plastic.

18. A shoe including an inlay, said inlay comprising a plate formed of a hard, resilient plate material, said plate including forefoot and heel regions and forming inside and outside edges each extending along the forefoot and heel regions; said plate formed with profiling disposed within said forefoot region and extending transversely relative to a longitudinal direction of the inlay; said profiling having a cross-section consisting of periodically repeating profile elements, each profile element comprising a ridge and a recess, each profile element extending non-perpendicularly relative to said longitudinal direction such that said profile elements extend from said outside edge at a rearwardly open acute angle with respect to the longitudinal direction, said acute angle being in the range of 70° to 86°.

* * * * *

UNITED STATES PATENT AND TRADEMARK OFFICE
CERTIFICATE OF CORRECTION

PATENT NO. : 5,720,118

DATED : February 24, 1998

INVENTOR(S) : Helmut MAYER et al.

It is certified that error appears in the above-identified patent and that said Letters Patent is hereby corrected as shown below:

On the title page:

Correct the priority data of "89005979 U" as follows:

--[30] Foreign Application Priority Data

May 12, 1989 [DE] Germany 8905979.4 --

Signed and Sealed this

Third Day of April, 2001

*Attest:*

Nicholas P. Godici

NICHOLAS P. GODICI

*Attesting Officer*

*Acting Director of the United States Patent and Trademark Office*